United States Patent [19]

Hurwitz

[11] 4,041,661

[45] Aug. 16, 1977

[54] SINGLE FAMILY TOWNHOUSE UNITS

[76] Inventor: Myron Stuart Hurwitz, 4420 Forest Glen Court, Annandale, Va. 22003

[21] Appl. No.: 607,461

[22] Filed: Aug. 25, 1975

Related U.S. Application Data

[63] Continuation-in-part of Ser. No. 151,858, June 10, 1971, abandoned.

[51] Int. Cl.[2] ..... E02D 27/00

[52] U.S. Cl. ..... 52/169.4; 52/234; 52/174; 52/182; 52/204; 52/236.4

[58] Field of Search ..... 52/169, 169 DT, 234, 52/174, 182, 204, 236; D13/1 A

[56] References Cited

U.S. PATENT DOCUMENTS

| | | | |
|---|---|---|---|
| 3,874,137 | 4/1975 | Gentry | 52/169 |
| D. 207,201 | 3/1967 | Fonville | D13/1 A |

OTHER PUBLICATIONS

House & Home, vol. 31, May 1967, pp. 98–99, "Good Merchandising in 1967 No. 4".

*Primary Examiner*—Price C. Faw, Jr.
*Assistant Examiner*—Carl D. Friedman
*Attorney, Agent, or Firm*—Cushman, Darby & Cushman

[57] ABSTRACT

A townhouse unit built with the ground floor level at the approximate grade line in the front and being generally three stories in height is disclosed, appearing to be about two stories in height at the front and featuring, for example, two standard entrance doors (for individuals) in the front, each door leading to a different floor level, one being a formal main entrance door, leading to the main or middle level and opening into a spacious, two-level formal entrance area of substantially the same width throughout, with an interconnecting, fully exposed, decorative stair treatment, and the other door being a fully exposed, service or convenience door, opening into a generally, centrally located service or convenience entrance corridor at the ground floor level.

32 Claims, 15 Drawing Figures

INVENTOR.
MYRON STUART HURWITZ
BY
Cushman, Darby & Cushman
ATTORNEYS

INVENTOR.
MYRON STUART HURWITZ
BY
Cushman, Darby & Cushman
ATTORNEYS

INVENTOR

MYRON STUART HURWITZ

BY Cushman, Darby & Cushman
ATTORNEYS.

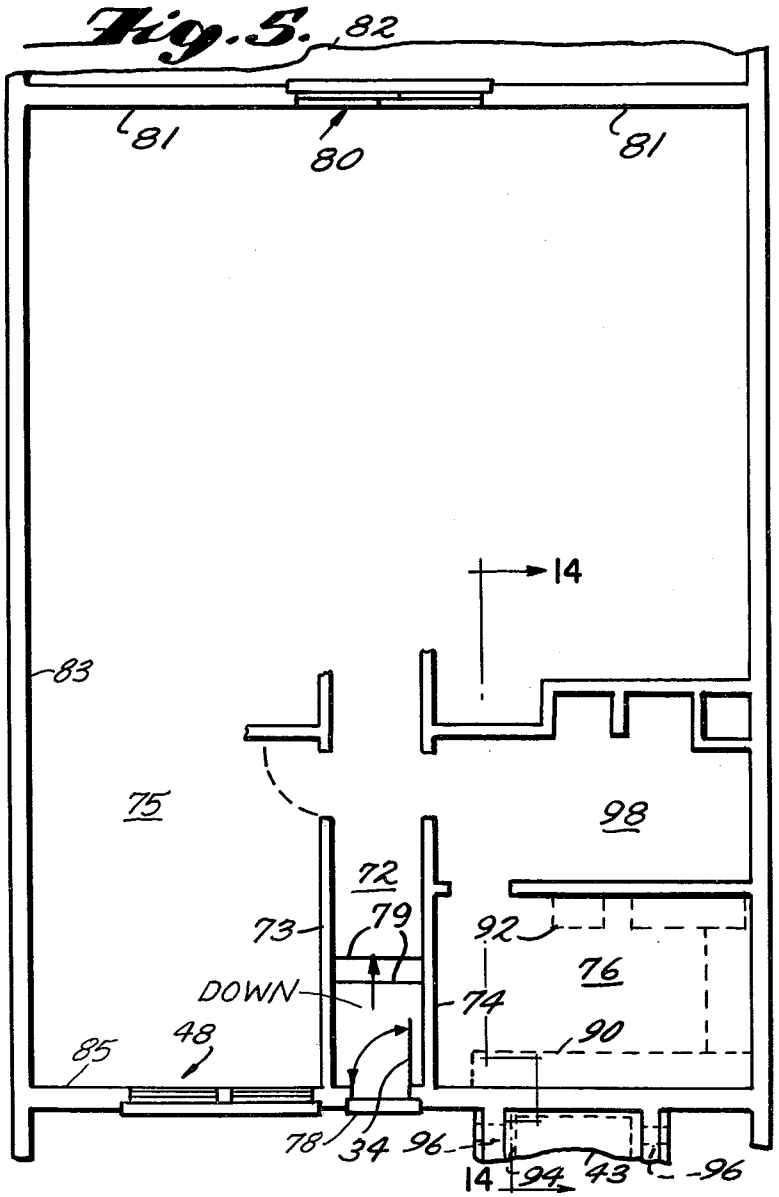
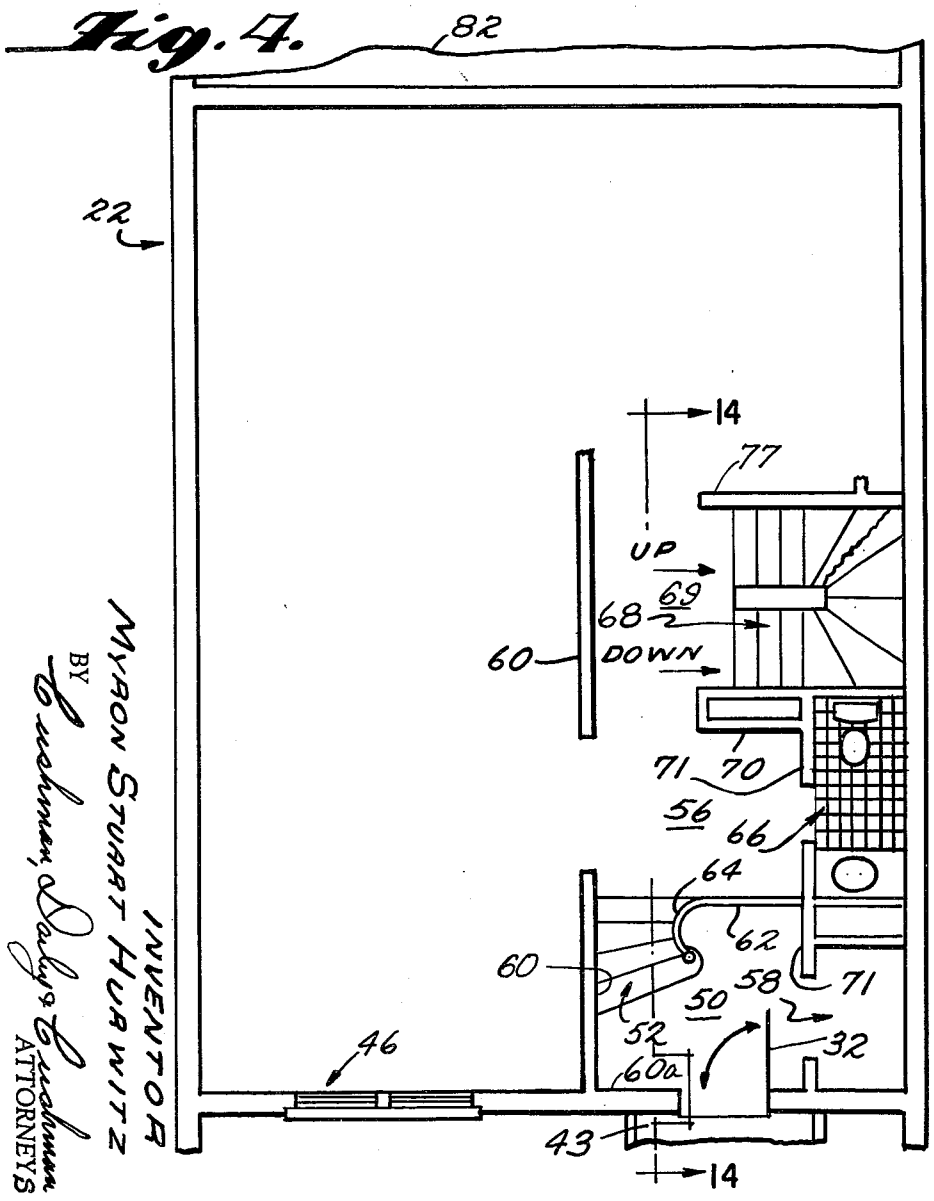
INVENTOR
MYRON STUART HURWITZ
BY Cushman, Darby & Cushman
ATTORNEYS

INVENTOR

MYRON STUART HURWITZ

BY Cushman, Darby & Cushman
ATTORNEYS

SINGLE FAMILY TOWNHOUSE UNITS

This application is a continuation-in-part of my copending application, Serial No. 151,858, filed June 10, 1971 and now abandoned.

BACKGROUND AND OBJECTS

The present invention relates to townhouses and in particular to suburban or rural townhouse complexes.

PRELIMINARY CONSIDERATIONS

The suburban or rural condominium townhouse project is a relatively new concept. Its architectural relationship to the low cost urban row house is as remote as comparing a tenement to a luxury apartment house. One might understand the concept better if a comparison were made between the more expensive and exclusively located historic urban townhouse and the currently popular suburban or rural townhouse.

The historic urban townhouse represented high density, single family housing in the city. Attached by common sidewalls and forming a contiguous group, these multistoried structures would typically encompass an entire city block. Including the basement or bottom level, it was primarily a four if not five story structure. Limited by the fixed grid of city street layout, the front facades matched the property lines which in turn were commonly in line. The typical facing material used was brownstone and the fenestration treatment was, of cource, traditional and rigidly formal.

Because most historical city townhouses did not have service alleys in the rear, a service or secondary entrance door in the front was essential. This service door was traditionally located under the formal exterior entrance stair or stoop, which was an imposing structure that was usually about 10 risers high. Such imposing "grand" stairway entrances to buildings in general (as is evident in our historic government buildings) are no longer in vogue as an acceptable, functional or aesthetically desirable entrance solution.

Since the service door was felt to be an eyesore, the hidden location under the stoop was ideal in that it did not aesthetically detract from the classic formality at the front of the townhouse, nor did it functionally compete in a design sense with the formal main entrance door. In addition, the service door and entrance corridor to which it opened were located to the extreme side of the townhouse, so as to logically allow maximum room sizes within the typical width constraint of a narrow townhouse. Finally, aside from the fact that the service door was hidden from view, it was generally in vertical alignment with the formal main entrance door and separated therefrom by a full story in height. This traditional solution of a service door in the front of a historical townhouse is in marked contrast to the present invention as will be explained.

The present suburban or rural single family townhouse represents an entirely different concept. Fostered by the currently rapidly rising cost of land in the suburbs and the concept of condominium ownership of property and common areas, it is the answer of the middle and upper middle income classes to home ownership, minimum maintenance and the means by which the amenities of large areas of land for recreation and atmosphere can be enjoyed. Because of unrestricted design parameters (as compared to rigid city street restrictions), suburban townhouse designs allow for greater privacy, variety in fenestration and informality in appearance. They appear to be in essence, attached suburban homes. The exterior materials most frequently used are brick and wood and the fenestration treatment is either traditional or contemporary.

The following are some features or parameters specifically applicable to conventional suburban and rural condominium townhouse projects:

A. A typical townhouse cluster or block comprises five to ten or more individual townhouse units that are attached, generally with the exposed front and rear walls of each unit unaligned to the adjacent townhouse unit.

B. The availability of greater land areas, as compared to the historical city townhouse, typically allows access to the rear of the townhouses.

C. Townhouse units generally have three floors. As in a conventional two-story detached home with basement, the bottom level of the townhouse unit could be: (1) a basement completely below grade; (2) partially below grade; (3) below grade in the front and at grade in the rear; (4) completely out of the ground (slab on grade); or (5) variations of the foregoing. Generally the arrangement of rooms is as follows: recreation room, toilet room, laundry, storage and mechanical areas or rooms, possible extra bedroom or garage would be on the bottom (basement or ground floor) level; living room, dining room, kitchen, family room and powder room would be on the middle level; and bedrooms and bathrooms would be at the top level.

D. Basically there are two main conceptual siting schemes for the front of a typical 3-story townhouse unit: 2-stories exposed in the front or 3-stories exposed in the front. In the 2-story front scheme the main entrance is at the middle (first floor) living room level. In the 3-story front scheme the main entrance is either: (1) at the ground floor, recreation room level; or (2) at the main (first floor) level. If at the ground floor level, you would reach the main floor by a flight of interior stairs. Alternatively, if the entrance is at the main floor level, the door is reached by a flight of exterior stairs (as in the historical city townhouse).

E. Typically there is an enclosed or partially enclosed rear patio and a patio door to every townhouse unit.

F. There are two main conceptual parking schemes for the townhouse project site plan, under consideration. In the most typical and popular scheme, parking is generally in the front of the townhouse clusters, in the other, parking is in the rear or in another designated area away from the main entrances of the townhouse units.

The desirability of parking in the front is that it most closely parallels the amenities and conveniences achieved in a life style associated with a detached suburban or rural home. The maximization of these amenities is the generalized objective of the townhouse invention under consideration.

SITE CONSIDERATIONS

One of the most popular and common site or grading solutions to a typical 3-story townhouse is to have two stories exposed in the front with the formal entrance at the middle or main (first floor) living room level and for grade to drop off and be at the bottom or ground floor, recreation room (walk-out) level in the rear. This scheme has been preferred to the 3-story front and rear townhouse grading solution.

Assuming grade to be at the middle or main (first floor) level in the front and at the bottom, ground level in the rear, this 2-story front, 3-story rear solution has the following advantages and disadvantages:

Advantages: The appearance at the front desirably resembles a conventional, single family, 2-story detached home. Functionally it is similar, as well, in that the formal entrance is at the main (first floor) living room level. The 3-story elevation in the rear is not considered to be aesthetically objectionable.

Disadvantages: (1) When you have an optional bedroom or den at the basement or ground floor level (in addition to the walk-out recreation room), that room is commonly located in the front which is below grade. As a result the "window" in this room (usually decoratively treated with closed drapes in the furnished models) receives its light and air through an unsightly areawell. (2) If a builder were to try and maximize the number of townhouse units in a project that had 2-story fronts and 3-story rears, it is not difficult to imagine that the natural terrain of the site would be changed substantially to achieve that objective. This could result in greater costs to solve drainage problems caused by the grade changes as well as the probable loss of many trees affected by these changes. It is for this reason that many developers in preparing their land for construction will completely bulldoze an entire site, stripping it of all foliage. This facilitates grade changes, but it also removes desirable landscape.

The 3-story front, 3-story rear solution has the following advantages and disadvantages:

Advantages: If all units in a townhouse project were sited with the bottom or ground floor recreation room level at grade, front and rear, it would minimize grade changes and excavation costs. This in turn would result in additional savings by allowing the maximization of natural terrain and drainage with the added advantage of saving existing trees.

Disadvantages: (1) The 3-story front townhouse has the comparable, formalized appearance of a traditional urban townhouse "building", which is considered to be somewhat out of place in the less formalized setting of suburban and rural areas. (2) The main entrance is undesirably located either at the ground floor, recreation room level, where you must climb an entire flight of interior stairs to reach the main (first floor) living room-kitchen level, or it is at the main floor level, but to reach it you must climb a full flight of exterior stairs. This outside flight of stairs is no longer considered to be a desirable design or functional entrance solution as it was once felt to be in historical city townhouses.

It is thus an objective of the invention to provide a novel townhouse project, of the type under consideration, with all units sited to complement the natural terrain by building them with the ground floor level at grade in both the front and the rear. This would minimize excavatios, grade changes, drainage problems and costs and present a greater opportunity to save and utilize existing trees. To achieve this, related objects of the invention are to avoid the appearance of undue height in the front and to provide main emtrance access from grade to the middle, living room level without going up a complete, continuous flight of stairs outside the unit.

CONSIDERATIONS REGARDING THE FORMAL INTERIOR ENTRANCE AREA

A previously constructed condominium townhouse project included, as a feature of all the townhouse units, a formal interior entrance area that included a curved stairway prominently located in the approximate center of the main floor of the unit. The stair joined the middle (living room) entrance level with the bedroom level above. To dramatize the stairway there was a spacious open stairwell that visually and physically tied both middle and upper levels together. Because of the excessive openness of the area surrounding the stairway at the middle and upper levels, all rooms (except the kitchen) on the living and bedroom levels were comparatively small. Regardless of that fact, the townhouses sold well primarily due to the impressive and open stairway entrance.

In other previously constructed condominium townhouse projects, the corridor entrances were meager and unattractive, or practically non-existent, with the front door in extreme cases opening directly into the living room. It is thus a further objective of the invention to design a townhouse unit with a physically spacious and formal entrance area featuring some type of decorative exposed stair treatment, for example, a decorative curved or right angle stairway that is fully exposed to view and without sacrificing all other room sizes or requiring undesirable additional expenses.

CONVENIENCE OR SERVICE ENTRANCE IN THE FRONT AS WELL AS A FORMAL MAIN ENTRANCE

In the present suburban or rural townhouse complex, where access to the rear is typically possible, as opposed to the traditional urban townhouse, a secondary convenience or service door in the front is not a necessity but would clearly be a functional and desirable amenity. The inability to conveniently and practically enter the typical townhouse being considered, through a front, side or rear door, is a decided and significant disadvantage as compared to living in a detached home. To reach the rear patio door of a typical townhouse unit from the front (or vice versa), one must walk around the attached adjacent townhouse units — such a walk can be tedious, especially for the families living in the center of an average eight-to-ten townhouse unit cluster, which in a practical sense precludes using the rear patio door as a secondary means of entrance.

Thus, when the weather is inclement, you do not have the basic convenience or amenity of entering a readily accessible service or convenience entrance door, as you would in a detached home. This feature for a townhouse would be especially desirable for families with children, as is evident. Furthermore, it would also be most convenient for taking bulky items out of or into the bottom ground floor storage level (e.g., golf clubs, skis, bicycles, carriage, snow tires, etc.) and to or from front to back. As explained there are typically two routes one can take to do this — both undesirable. One route is out through the rear patio door and around the adjacent townhouse units to the front. The other route, especially cumbersome for bulky items, is to go up the interior stairs, through the main living areas and out the front door.

Accordingly, a further objective of the invention is to design townhouse projects, of the type under consideration, with parking in the front of the townhouse unit and the option of being able to enter either a service or convenience, standard entrance door, or a formal, main entrance door both in the front of every townhouse unit.

Further objectives of this feature of the invention are: (1) to have the service or convenience, standard entrance door fully exposed (as opposed to the historical urban townhouse, where the service door is hidden from view and located under the formal entrance stoop) and yet not only be aesthetically acceptable but, in compensating for its detracting "service" appearance, not have it functionally or visually compete with the formal main entrance door; (2) to have the service or convenience door open into a generally, centrally located service entrance corridor at essentially the ground floor level (as opposed to the historical townhouse, where this service corridor is located to one extreme side of the townhouse); (3) to have the formal main entrance door located intermediate the ground and main (first floor) levels and lead to the main or first floor by way of a two level formal entrance area of substantially the same with throughout, in which the lower level is at said intermediate point and the upper level is coincident with the main (first floor) living room level, and where the main entrance door is reached without climbing a continuous and formidable full flight of outside stairs (as opposed to the historical townhouse in which you reached the main entrance door at the main floor level via an outside formal grand stair stoop, where the formal entrance door and service door, hidden below the stoop, where separated by a full story height).

SUMMARY OF INITIAL CONSIDERATIONS

The principal initial considerations that resulted in the present townhouse invention were: (1) to provide, in addition to the main entrance door, a standard service or convenience door that was readily and conveniently accessible from the front of a tyical townhouse unit; (2) to resolve this problem without an any way resorting to the historical city townhouse solution, which had no functional relevance in life style (or in its 4 – 5 multistoried, stilted and formal appearance) to current suburban or rural townhouse projects; (3) to achieve a distinctive, spacious, two level formal entrance area with a connecting decorative stair treatment which, though intended to be dramatic in effect, would not be formidable to climb; and (4) to achieve these results practically and economically.

SUMMARY OF MAIN OBJECTIVES

Summarizing the foregoing, the principal objectives of the present invention are to provide one or more of the following features in townhouses of the type under consideration: utilization of optimum siting conditions with, for example: (1) all townhouse units being three stores, built with the ground floor level at grade, and adapted not only to appear to be two stories in height at the front but to functionally perform as such in practical use; (2) each townhouse unit to have two distinct and separate entrance doors in the front that lead to different floor levels, one being a formal main entrance door and the other a service or convenience standard entrance door that is fully exposed and yet aesthetically acceptable and which does not, as a result of being exposed to view, functionally compete in appearance with the formal main entrance door; (3) a service or convenience standard entrance door that opens directly into a generally centrally located service corridor, which is essentially at the ground floor level; (4) a formal main entrance door, located intermediate the ground and main (first floor) levels, that opens into the main (first) floor by way of a two level, formal entrance area of substantially the same width throughout, in which the lower level is at said intermediate level, constituting a formal entry area, and the upper level is coincident or substantially coincident with the main (first floor) level, constituting a formal foyer area; and where both formal entrance, open area levels are interconnected by a decorative and fully exposed stair treatment; (5) a physically spacious 2-level formal interior entrance area scheme, which to be practical should not as a result of its spaciousness, correspondingly detract in size from all the other rooms at the main (first floor) level or from all areas below and adjacent this two level formal entrance area which areas should be completely and functionally utilized so that, in essence, no space at any level in the townhouse unit is sacrificed by the implementation of the exterior and related interior embodiments of the invention; and (6) the attainment of these objectives to be achieved in a thoroughly practical and economic manner.

Regarding the latter objective, it shuld be understood that the inventor, an architect, presently contemplates embarking on a new career in construction and intends to build this townhouse invention in future projects. Mindful of the risks involved, it was implicit from the start that, aside from inherent aesthetic considerations, the solution of the present invention had to be realistic in all of its architectural and interrelated engineering considerations (site details, construction details, structural framing, mechanical, plumbing and equipment considerations, etc.). Put another way, whatever merits were to be achieved, same had to be accomplished without added cost. It was mandatory that the final result be competitive to existing art. To that end basic simplicity to effect systemization was paramount. Thus, if certain aspects of the solution, which resulted in the present invention, would increase cost, they would have to be balanced by aspects of the invention that decreased cost. Finally, it is implicit that though certain complex and technical parts of the invention may not be readily perceived, they are, nevertheless, inherent in the present solution in spite of its apparent simplicity.

Other and more specific objects of the invention will be in part obvious and in part pointed out hereinafter.

The novel features of the invention may best be made clear from the following description and accompanying drawings in which.

Figure 7:
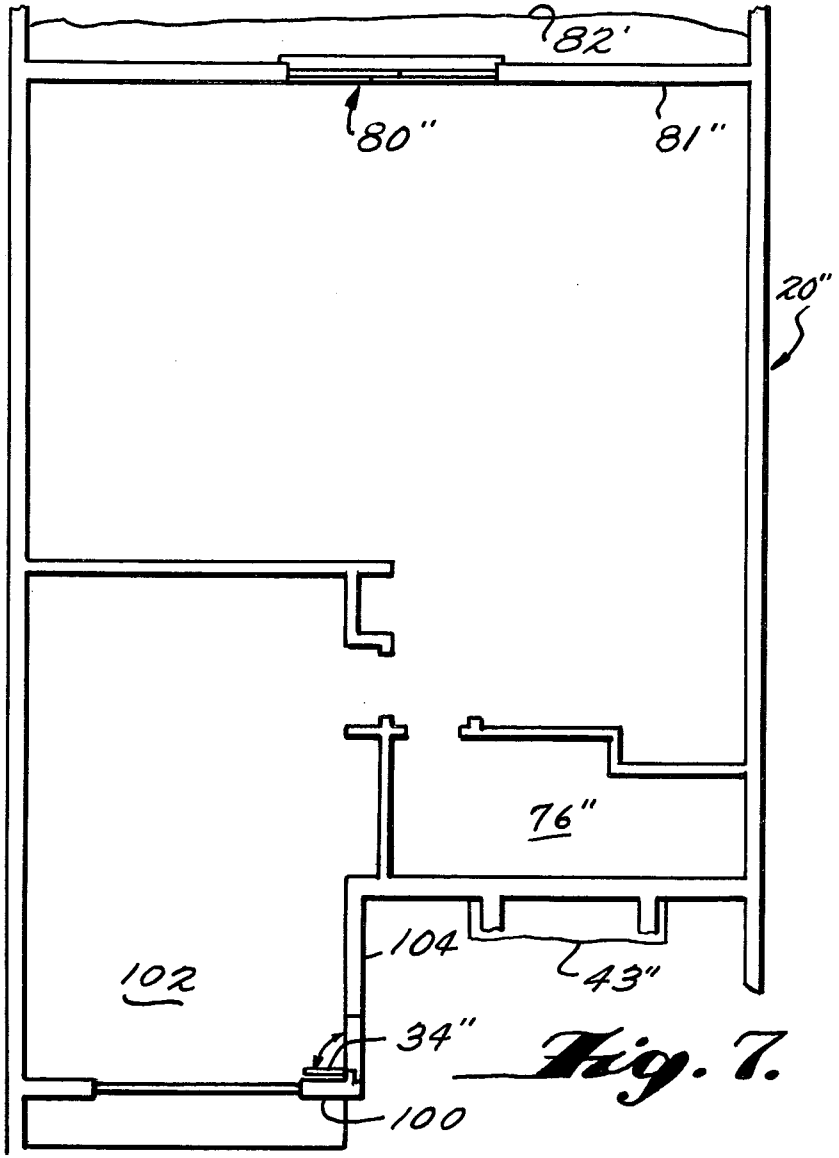
Figure 3:
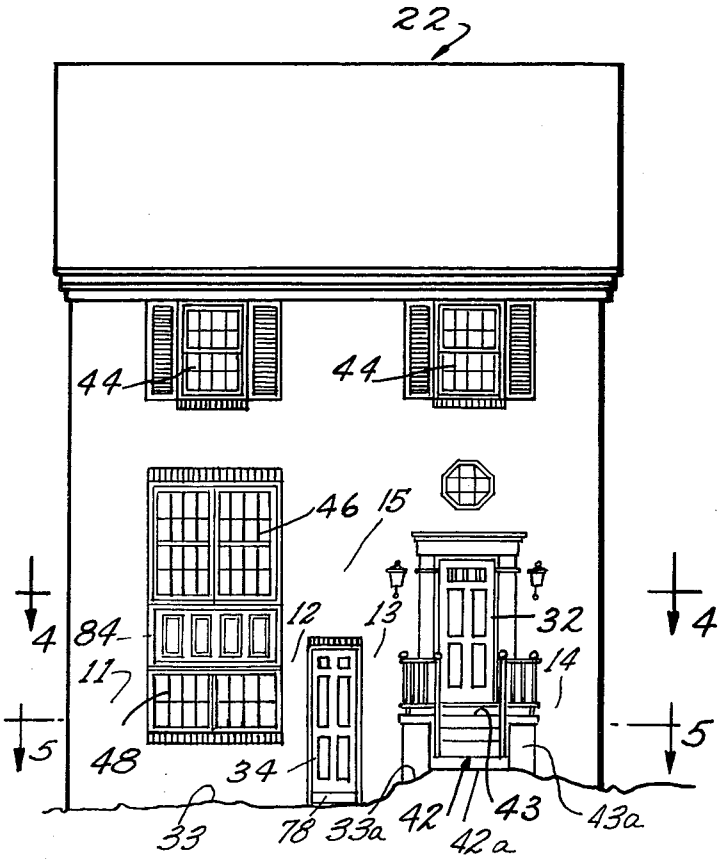
FIG. 3 is an enlarged front elevational view of a townhouse unit embodying the invention.
Figure 6:
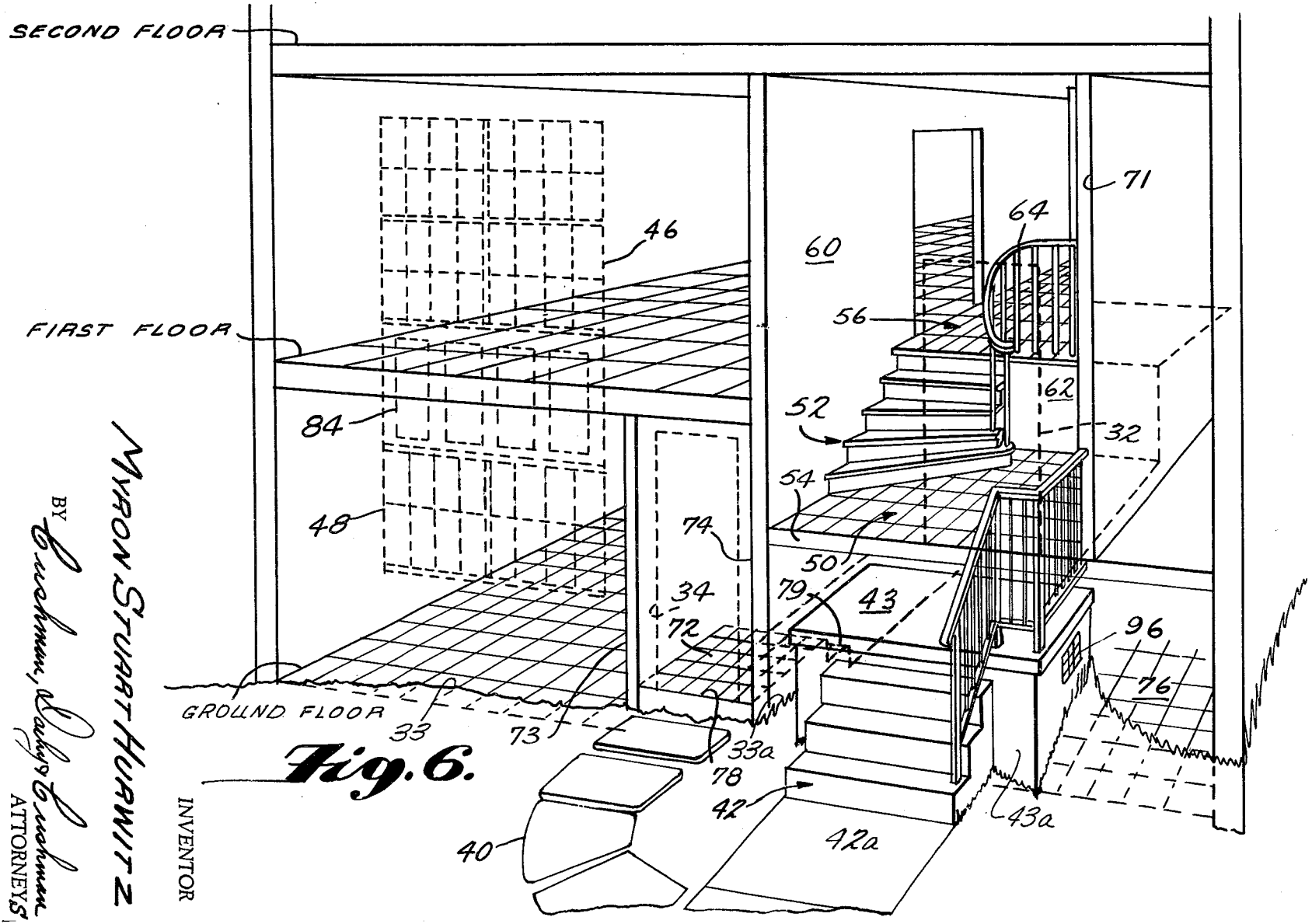
Figure 8:
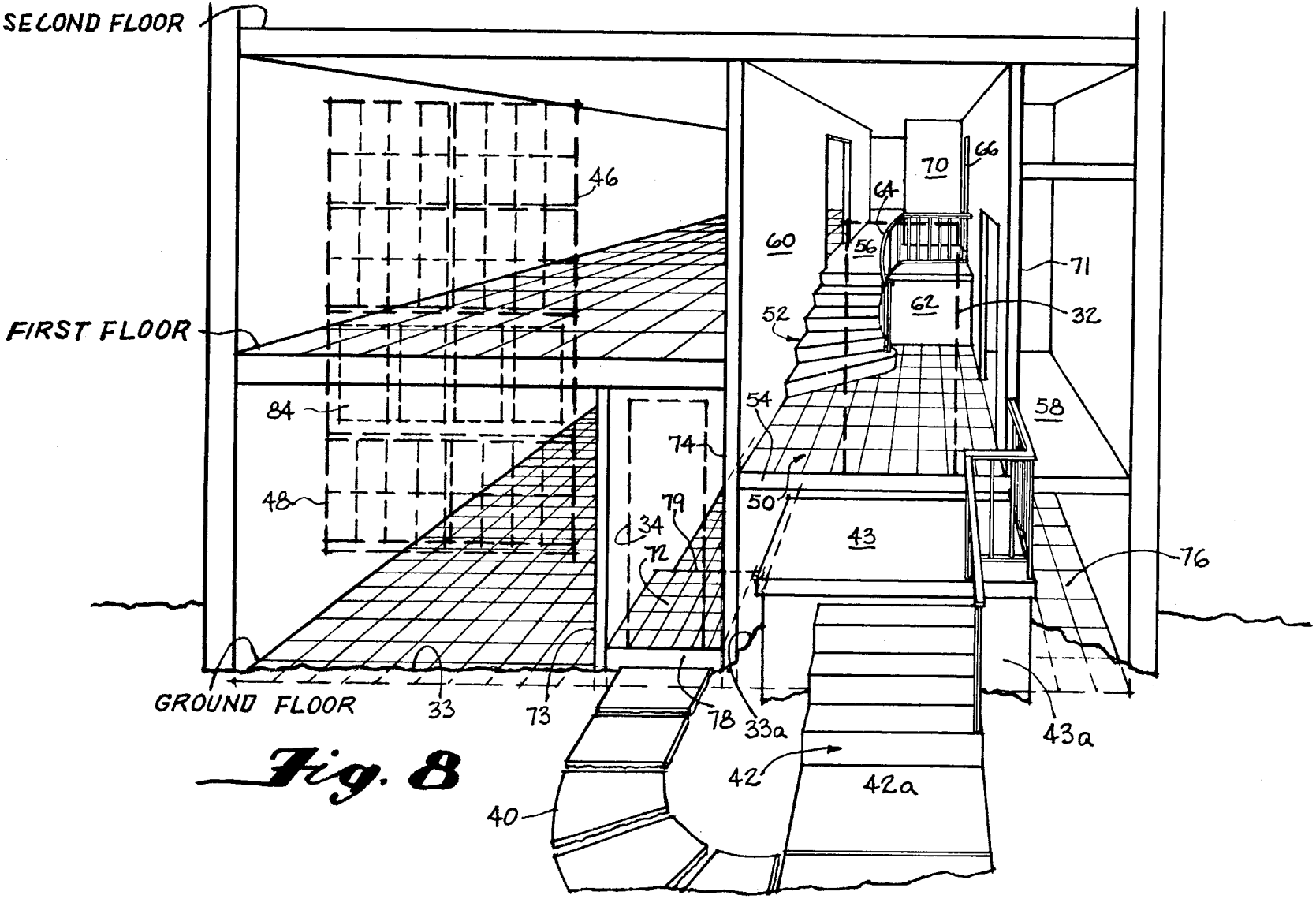
Figures 9, 10, 13:
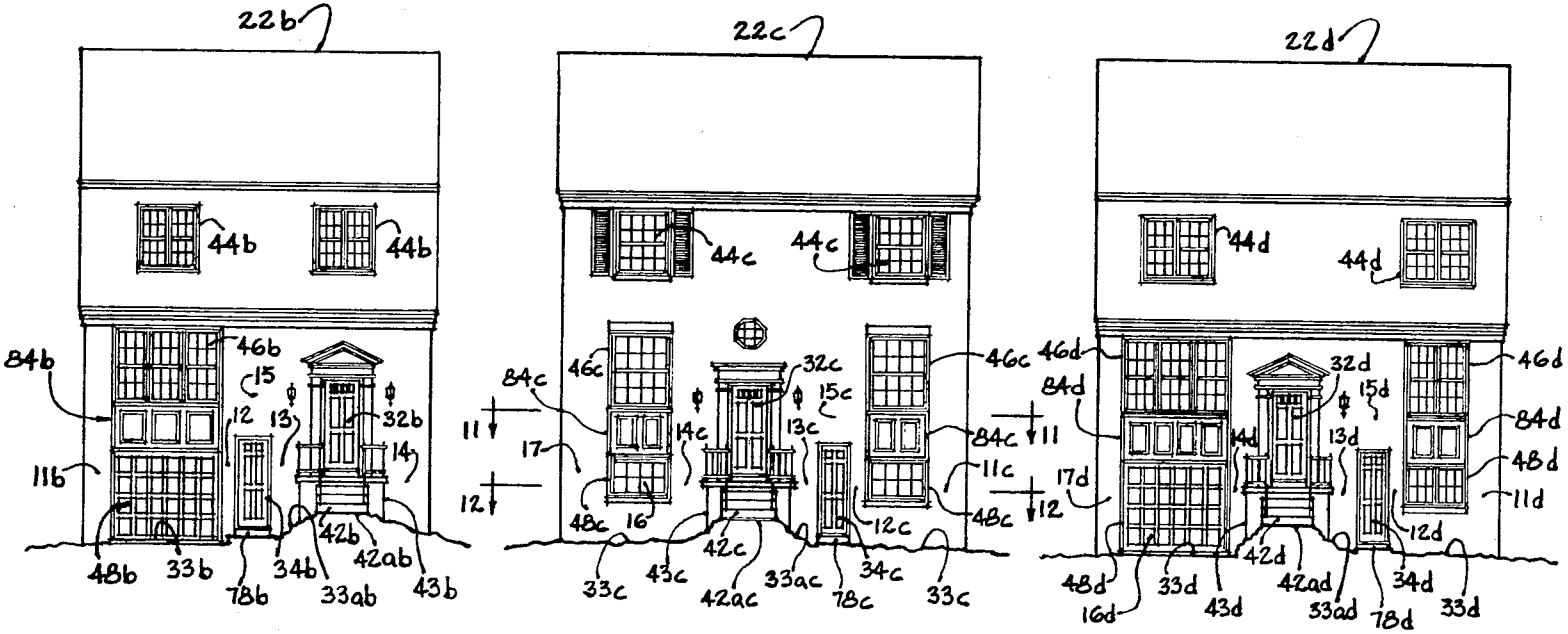
Figure 12:
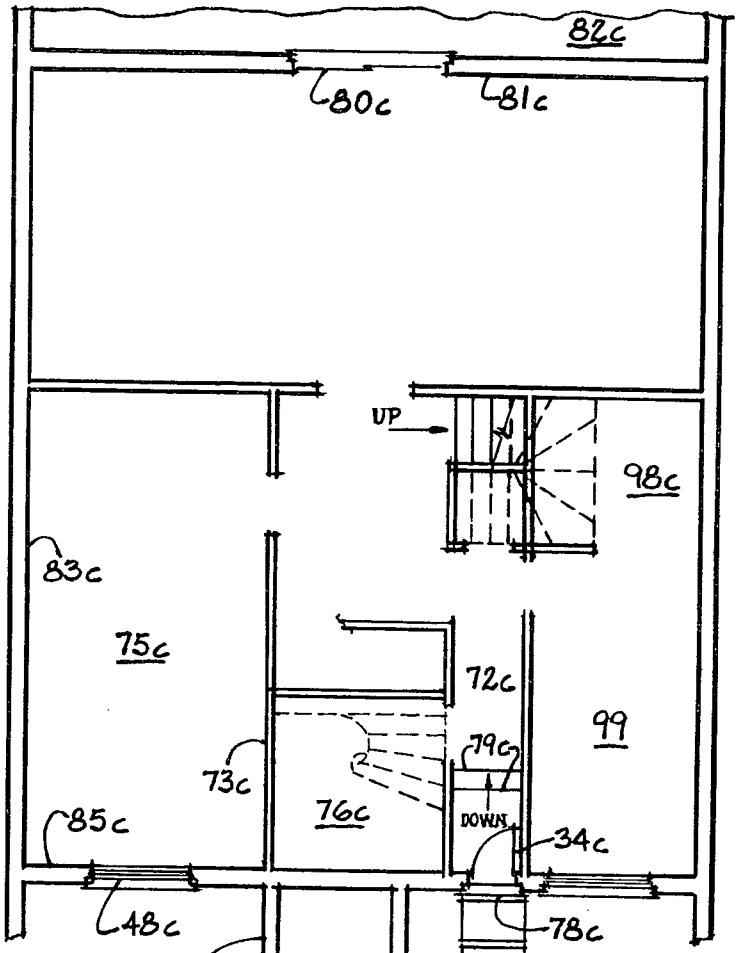
Figure 11:
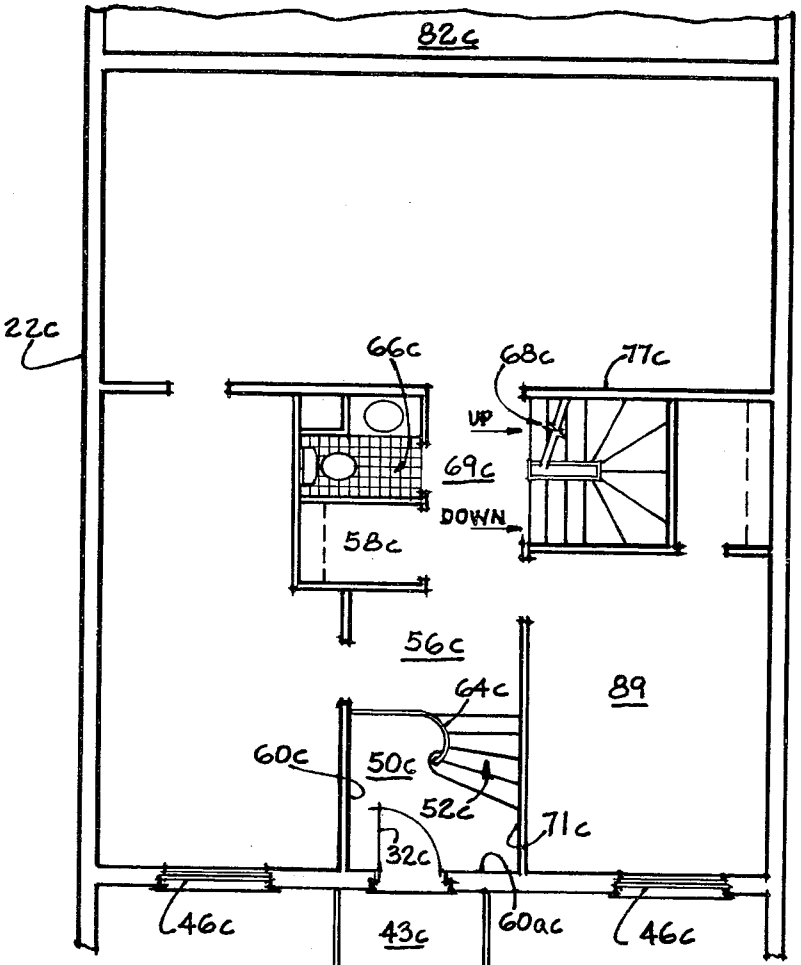

FIGS. 4 and 5 are schematic floor plans looking respectively in the direction of arrows 4—4 and 5—5 of FIGS. 3 ad 9 and omitting, for convenience of illustration, certain portions of the respective floor pians not germane to the invention;

FIG. 6 is an enlarged, schematic, perspective view of the unit shown in FIGS. 3, 4 and 5 and taken from the outside, with the front wall removed and the front standard entrance doors and the formal large windows shown in phantom lines for illustrative purposes. It shows an exemplary main, interior entrance area and an exemplary service, interior entrance corridor at the approximate grade line, constructed in accordance with the invention;

FIG. 7 is a schematic floor plan similar to FIG. 5 but showing another embodiment of the invention;

FIG. 8 is an enlarged, schematic, perspective view similar to FIG. 6 but at a different angle of view to more clearly demonstrate the two level formal entrance area of substantially the same width throughout;

FIG. 9 is a front elevational view similar to FIG. 3 but showing another embodiment of the invention;

FIG. 10 is a front elevational view similar to FIG. 3 but showing another embodiment of the invention;

FIGS. 11 and 12 are enlarged schematic floor plans looking respectively in the direction of arrows 11—11 and 12—12 of FIG. 10 and omitting, for convenience of illustration, certain portions not germane to the invention; and FIG. 13 is a front elevational view similar to FIG. 10 but showing another embodiment of the invention.

Figure 15:
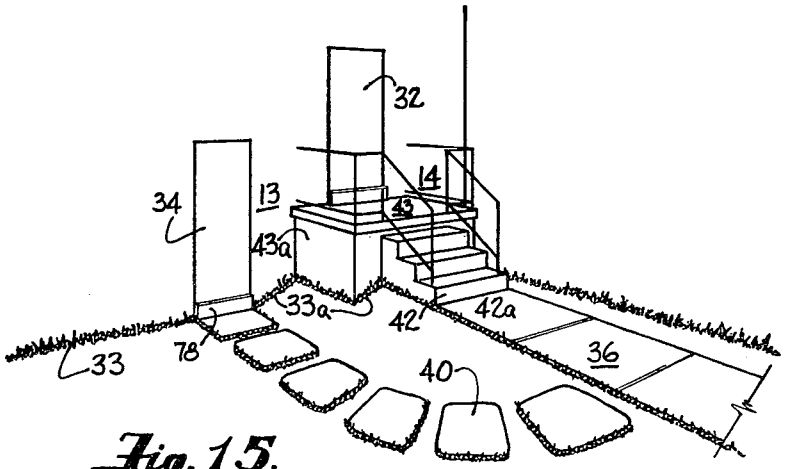
Figure 14:
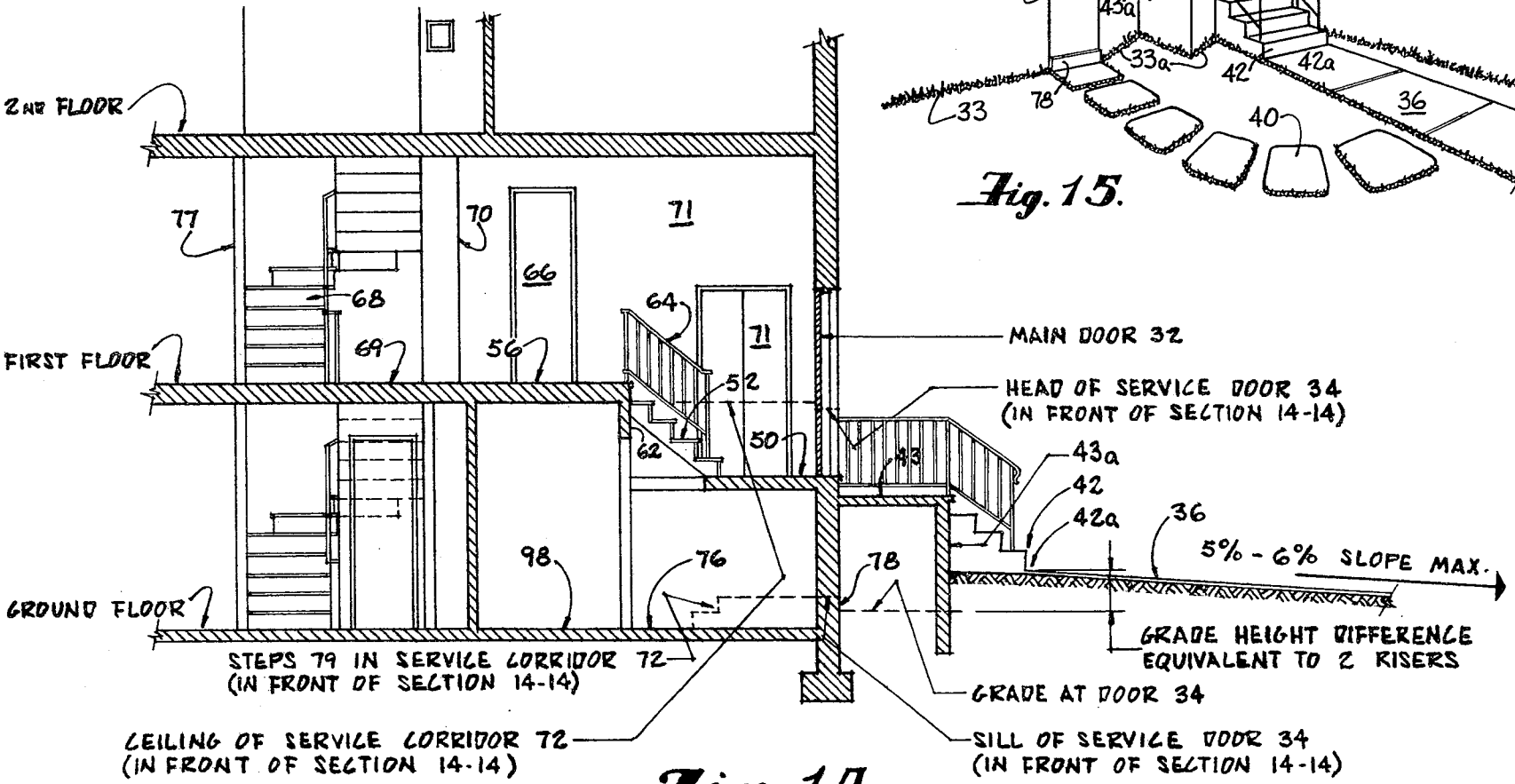

FIG. 14 is an enlarged section looking in the direction of arrows 14—14 in FIGS. 4 and 5. It shows the basic interrelationships between the exterior and interior embodiments of the invention;

FIG. 15 is a schematic perspective view taken from the outside. It more clearly shows the raised grade at the main front entrance and illustrates the basic essence of the elemental relationships which comprise the exterior embodiment of the invention, wherein the dual entrance scheme starts at the entrance walkway and transitionally, subtly leads up or down to either the main floor level by way of an elevationally raised entrance stoop or to the ground floor level by way of a fully exposed service door, eliminating the need for an imposing type, outside stairway, normally required for a 3-story front townhouse, which has a formal entrance door that opens to the main floor level.

DETAILED DESCRIPTION

The functional design solution of the invention resulted in a townhouse that is to be built with the ground floor level at grade, allowing for, among other things, a standard service or convenience entrance door opening directly into a generally, centrally located entrance corridor at essentially the ground floor level, and an extra, optional bedroom (or garage) in the front of the ground floor level desirably at the approximate grade line with windows receiving direct light and air (not through an areawell, which is typical). If the optional room is a garage, then understandably the window to that space would instead be a garage door.

Major problems to be overcome included the following: (1) How not only to make a 3-story (front and rear) townhouse appear to be two stories in height at the front, but how to make it functionally perform as such in practical use; (2) How to locate the standard service door so that it would not be an eye-sore and would not compete with the main, formal entrance door, though it would be completely exposed to view; (3) How to include this additional width element, the standard service door, including the generally, centrally located service corridor at the ground floor level, within the limited width constraints of a typical townhouse; (4) How to get someone from grade to the middle (first floor), living room level without going up a continuous flight of stairs either inside or outside the townhouse unit; (5) How to achieve a spacious formal interior entrance area of two levels and of substantially the same with throughout, having an interconnecting, fully exposed, decorative stair treatment, without sacrificing room sizes or complete utilization of space on any floor level in the townhouse unit.

TOTAL INTERIOR MAIN ENTRANCE PLAN AREA

To understand how the problem identified as item (5) in the preceding paragraph was resolved, an explanation of the comparable state of the art must be given: The total interior main entrance plan area of a townhouse is typically comprised of the following sub-area elements: (1) a formal entry sub-area (it is not unusual, in extreme examples, for this sub-area to be inadequately and indistinctively part of the living room); (2) entrance closet sub-area typically minimal in size; (3) corridor sub-area (A residential corridor may be defined as a traffic aisle, open or enclosed by side walls, that is typically 3 - 4 feet in approximate width and which functions as a circulation link between rooms or definable areas. It is not unusual for this sub-area to be subtly within the confines of the living and/or dining room to make those rooms appear deceptively large.); (4) powder room sub-area; (5) sub-area for the main stair; (6) and, sub-area for the main stair landing.

In the total entrance plane arrangement of these sub-area elements, it is typical that the sub-area devoted exclusively to formal entry is minimal in size and invariably, indistinctively blends into part of the corridor sub-area, such as a corridor entrance area. This corridor sub-area is, on an allocated basis, typically maximum in total area as compared to the distinguishable, minimal sub-area exclusively devoted to the formal entry. So much area, in fact, is proportionately and definably devoted to corridor circulation, aside from the main stair and main stair landing sub-areas, it may be fair to conclude that the total corridor sub-area within the total entrance plan area arrangement, is typically excessive and, as such, inefficient as to its proportionate use of space for this necessary circulatory function.

It is further typical that the sub-area for the main stair of a townhouse is usually in an essentially straight run configuration. Other stair configurations used are "L" and "U" shapes. When a "U" stair is used it is typical that the intermediate return landing between floors is level, without risers.

With the foregoing explanation and facts in mind, the following innovative, functional planning ideas were developed and employed to achieve the novel interior main entrance plan embodiment of the invention: (1) utilization of an exceedingly studied and efficiently designed, compact and continuous main U stair, with winders on the return instead of the typical, level, intermediate return landing (While stair winders that typically come to a point, and meet minimal tread width requirements at the approximate center of the tread, are allowable by the codes, they are nevertheless undesirable and present a safety hazard where the treads and risers intersect at the radial point. It is, therefore, significant in a detail sense that the winders in my exceedingly compact and continuous main U stair, surpass FHA and BOCA code requirements by being 4 inches minimum in width at the narrow end of the tread. This results in a standard width stair that, though minimal in length, still exceeds minimum stair code requirements); (2) diligent years of prolonged trial and error juxtatpositioning and refinement of the compact sub-area main stair, and the other entrance sub-area design elements, to achieve an atypical, minimum and definitive, total corridor sub-area; (3) the critical conbination of this minimal total corridor sub-area with the main stair landing sub-area so that they substantially coincided; (4) this minimal, coincident, corridor-stair landing sub-area in conjunction with the remaining efficiently designed sub-area elements, evolved into a total, novel, main entrance plan arrangement, which allowed a maximum allotment of definitive space for the formal entrance sub-area of two levels and substantially of the same width throughout. The present solution includes an atypically large entrance closet, a standard sized powder room and, in addition, chase space for mechanical heating-air conditioning ducts and atypical laundry chute to the mechanical room and laundry room respectively, which are efficiently located below the two-level formal entrance area, as will become evident.

Thus, by efficiently minimizing the typically excessive total corridor sub-area, by effectively minimizing the sub-area of an exceedingly compact main U stair and, in addition, making the minimal corridor sub-area substantially coincident with the main U stair landing sub-area; the resulting saved area was utilized in such a manner as to achieve a novel total main entrance plan area arrangement. This inventive solution of the combined sub-area elements is epitomized by the unusually spacious and novel formal entrance area of two levels, with an interconnecting, fully exposed, decorative stair treatment, within the critical width constraints of a narrow townhouse. My solution, in spite of the open spaciousness achieved at the main entrance, did not detract from the room sizes or complete utilization of space on any floor level in the townhouse unit.

It will be appreciated that in atypically wide townhouses, where the dimensional width constraints of the novel total main entrance plan area are not as critical, the length of the main U stair could be increased, which would eliminate the need for winders on the return and instead allow a more typical, level, intermediate, return landing condition without risers.

FORMAL MAIN ENTRANCE SCHEME

The formal main entrance door problem of getting some from grade to the main (first floor) living room level without going up to a continuous flight of stairs either inside or outside the townhouse unit was resolved by: (1) using a typical, formal entrance stoop raised, for example, about one and a half feet above grade, with a minimum number of steps to conveniently permit reaching an intermediate level about three quarters of the way up to the main, living room level; (2) when opening the formal front door, entrance would be provided into the main (first) floor by way of a two level, formal entrance area of substantially the same width throughout, in which the lower level would be at said intermediate level and constituting a formal immediate entry area, and the upper level would be coincident (or substantially coincident) with the main, first floor level, constituting a formal upper foyer area; and where both formal entrance, open area levels would be interconnected by a decorative, fully exposed, curved stair treatment. The combined sunken formal entry, high ceiling effect, decorative, fully exposed curved stair treatment and open spacious upper foyer would create a dramatic impact that is distinctively different as compared to a typical split level stair landing entrance area. The essential psychological objective that had to be accomplished in this scheme was to make it appear that the combined two level entry area and interconnecting stair treatment were done for purely dramatic and aesthetic reasons. Of great significance to this achievement was to keep the number of interconnecting steps involved at the two level entrance area to a minimum so that the decorative stair treatment would not become visually formidable and a drudgery to climb. To further minimize the appearance of stairs, the main interior stairway of the townhouse is substantially hidden from view, when one is on the sunken formal entry level.

Thus, starting at the sidewalk at the bottom step of the entrance stoop, which at that location in the illustrative embodiment of the invention is shown to be about three interior risers or about two feet above the ground floor level of the townhouse, one would walk up a minimum number of exterior steps to the stoop landing. Pausing to open the main front door, one would then step into the sunken formal entry area and would be aware of the high ceiling, the decorative fully exposed, curved stair treatment and the open spacious upper foyer of substantially the same width as the sunken formal entry. A minimum number of steps would then be climbed to reach the upper foyer, which is coincident or substantially coincident with the main (first floor) living room level. In this manner, a person will proceed from grade (the sidewalk elevation at the bottom step of the stoop) to the main, living room level without being aware that he has done so and without having to climb a tiresome, continuous flight of stairs inside or outside the townhouse unit.

Figure 1:
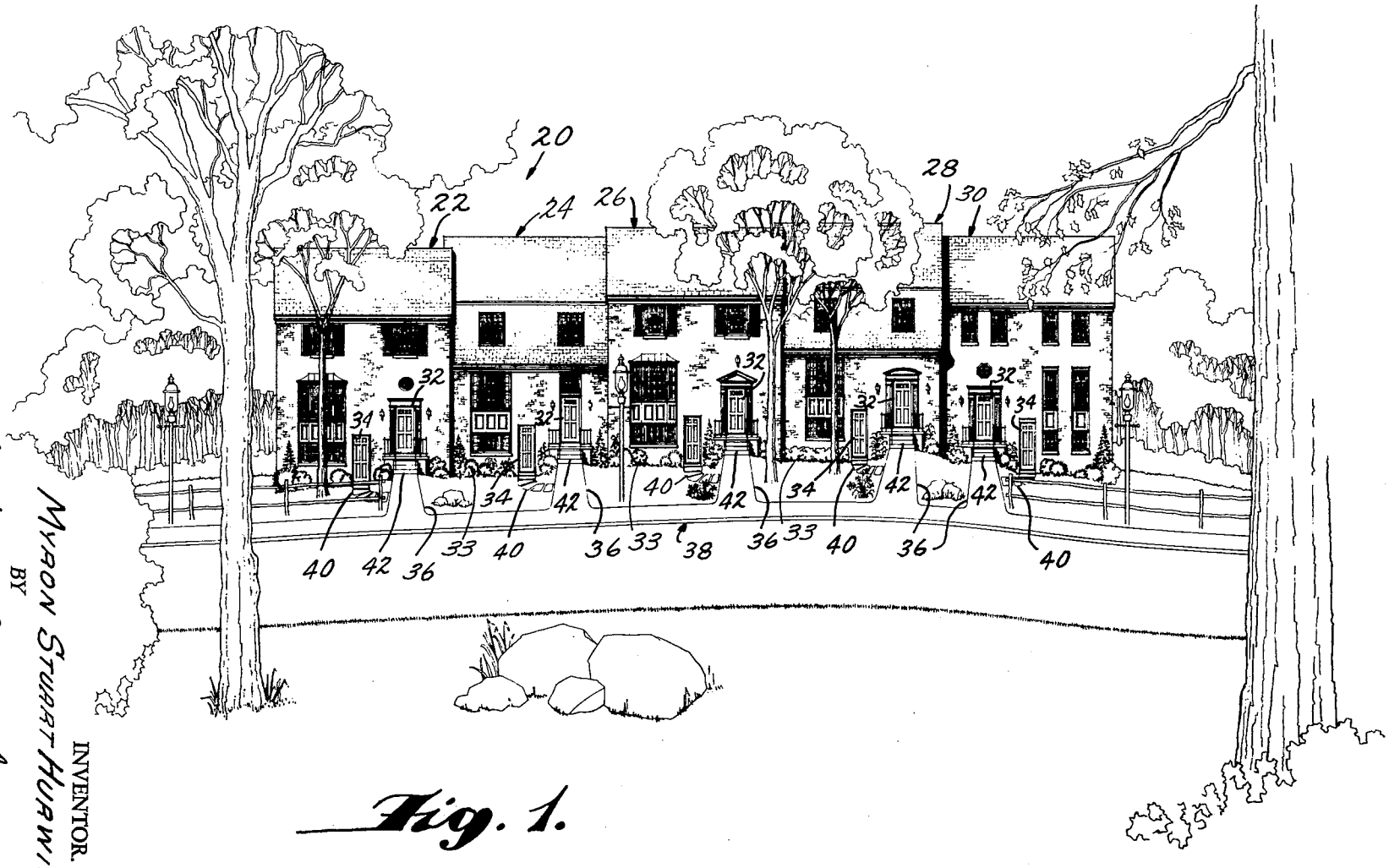
FIG. 1 is a perspective view of the front of an attached cluster of townhouse units constituting an exemplary embodiment of the invention.
Figure 2:
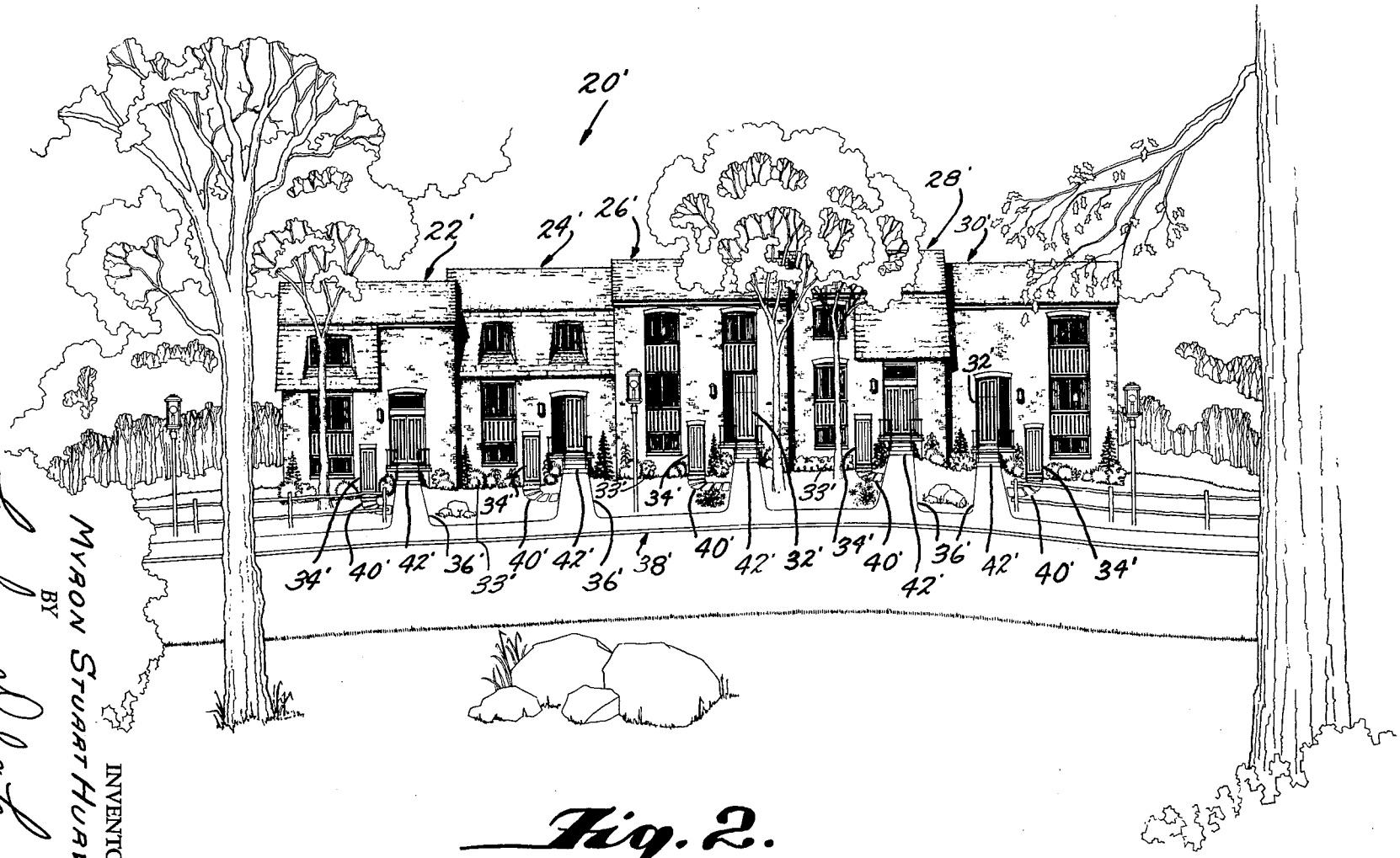
FIG. 2 is a perspective view of the front of a cluster of attached townhouse units constituting another exemplary embodiment of the invention.

Referring now to the drawings, wherein like or similar reference numerals have been used to designte like or similar parts, FIG. 1 shows a cluster 20 of attached townhouse units 22, 24, 26, 28 and 30 embodying the invention. FIG. 2 shows a cluster 20' of attached townhouse units 22',24', 26', 28' and 30' constituting another embodiment of the invention. Other embodiments of individual townhouse units are shown in FIG. 7, in FIG. 9, in FIGS. 10 - 12 and in FIG. 13 wherein reference numerals similar to those used in FIG. 1 have been employed for convenience.

As shown in FIGS. 1, 2, 3, 6, 8 and 15, each of the townhouse units comprises: a main entrance door 32 which is comprised of at least a single door for use by individuals and an exposed standard service door 34 in the front for individuals and being substantially of the same width as at least the single door in the main entrance 32; a main entrance walk 36 sloping up from sidewalk 38 to a high point **42*a* at the base of steps 42 of the entrance stoop 43*a*; steps 42 leading to an entrance platform 43, a step below main door 32; substantially level grade 33 is shown across the front of the townhouse unit, which steeply rises at 33*a* in the immediate area of the elevated stoop 43*a*; a service walkway 40 sloping down from the main entrance walk 36 to standard service door 34; and windows 44, 46 for the second and first floors, respectively, which windows 46 for the first floor are shown combined with windows 48 for the bottom or ground floor level, forming a singular and decorative, window group structure 84.**

The rear and external sides and the roofs of the cluster 20 (20') of townhouse units may be of any suitable, attractive design, as will be appreciated.

As shown in FIGS. 4, 6, 8 and 14 main entrance door 32 opens into the main (first) floor by way of a two level, formal entrance area of substantially uniform width. The immediate, lower level entry area 50 is interconnected to the upper level foyer area 56 at the first floor by a fully exposed, curved stair treatment 52 with stair railing 64 being coincident with the open foyer level railing. The two level entrance area is defined by side walls 60*a*, 60, 70 and 71. The lower entry area 50 is defined by walls 60, 60*a*, 71 and partial wall 62 (below the railing); the upper foyer area 56 by walls 60, 70, 71 and railing 64. It will be appreciated that decorative railing 64, at stair 52 and/or at the change in levels, could have an open and/or closed design treatment.

A conventional closet 58 is shown off the lower entry area 50 and a powder room 66 is shown off the upper foyer 56. The main interior stairway 68, connecting the first floor both to the bottom or ground floor and to the second floor, preferably is disposed behind foyer wall 70 so as to be substantially not visible upon entrance through the main door 32. Circulation, corridor area 69 is shown coincident with the landing area of main stairway 68. The rest of the layout or floor plan for the first floor and that for the second floor may be as desired, depending on the size of the townhouse unit, and design considerations, as will be understood.

It will be appreciated that variations in the two level formal entrance area just described would be obvious to those skilled in the townhouse building art. For example, conventional closet 58 and powder room 66 could be interchangeably located, such that closet 58 could be off the upper foyer and powder room 66 off the lower entry area. Further, it will be appreciated that though it is the inventor's intention and desire, as previously explained, to have main stairway 68 substantially hidden from view when entering into formal entry 50, it would be possible in commonly known aesthetic variations to eliminate solid wall 70 and have an open railing or full height grille design, wall treatment instead, which would essentially expose portions of the main stairway 68 to view. The same possible treatment would equally apply to wall 77.

As shown in FIGS. 5, 6, 8 and 14, the service or convenience standard door 34 opens into an interior entrance corridor 72 generally centrally located and defined by walls 73 and 74; and a mechanical room 76 (for example, housing parts of heating and/or cooling units 90, and water heater structure 92 shown in phantom) is provided below the entry area 50. The level of the ground floor preferably is generally at grade, but it may be a little above or a little below grade, as design considerations may indicate. It has been found that even though the mechanical or utility room 76 is not of full height (because it is under the entry area 50), it is sufficiently high (for example, about five feet) to accommodate standard heating and/or cooling units and a water heater. Moreover, a condenser 94 for the cooling unit 90 may be advantageously arranged below or under the slab of the entrance stoop with suitable vents or openings 96 to atmosphere, as shown in FIGS. 5 and 6.

It will be evident that the mechanical room 76 is desirably located so as to isolate any noise generated by the mechanical equipment therein. The laundry room 98 (under the foyer area 56) is shown in FIGS. 5 and 14 as adjoining the mechanical room 76, likewise so as to isolate noise, etc. Optionally usable room space 75, shown partially defined by walls 73, 83 and 85, has windows 48 indicated in wall 85, that are part of formal window group structure 84. It is intended that when room space 75 is used as a garage, windows 48 would instead be a garage door 48*b* and be part of a formal window-garage door group structure 84*b* as shown in FIG. 9.

Standard entrance door 34 is shown in FIGS. 6 and 8 as about a step 78 above grade, and steps 79 may be provided in entrance corridor 72, leading down to the floor of the bottom ground floor level, as shown in FIGS. 5, 6 and 8.

Conventional sliding (or swinging) doors 80 are shown arranged at the rear of the bottom floor in wall 81 and opening, for example, onto a terrace or patio 82 (shown fragmentarily in FIGS. 4 and 5). The remainder of the floor plan or layout for the bottom floor may be as desired, depending on the size of the townhouse unit and design considerations, as will be understood.

A 3-STORY FRONT TOWNHOUSE THAT APPEARS TO BE A 2-STORY FRONT TOWNHOUSE, AND FUNCTIONALLY WORKS AS SUCH

The problem of making a 3-story front townhouse, whose ground floor level is at the approximate grade line, appear to be a 2-story front townhouse (that also functions or works as such in practical use) was solved by using typical design treatments and elements in an atypical and novel manner. To recognize the distinct elemental differences to existing art that do exist, which in novel combination constitute this particular embodiment of the invention, an explanation of the comparable state of the art must be given.

It is not unusual in existing townhouses to have the following aesthetic features in isolated and unrelated exampled conditions: (1) Windows (separated by a floor) that are vertically combined and aligned into one formal, overall window group structure. In contemporary architecture, especially, it is typical to combine and align windows vertically at all floor levels in all classifications of building use. However, as in this townhouse instance, when only two out of a possible three floor levels of windows are vertically combined and aligned for the aesthetic emphasis of only one window group structure, it is typical in the art to combine the bedroom (second floor) level windows with the main (first floor) level windows. (2) In a 2-story front townhouse where a formal stoop is used in conjunction with a main entrance door that is at a half level between the first and basement floors (as in a split stair landing entrance), it is typical that the substantially level grade in the front of the townhouse unit is generally coincident with the sidewalk elevation at the bottom step of the formal stoop. (3) Similarly, in a 3-story front townhouse, where a formal stoop is used in conjunction with a main entrance door that is at an intermediate level between the ground and first floors (as in an intermediate landing entrance level), it is typical that the substantially level grade in the front of the townhouse unit is generally coincident with the sidewalk elevation at the bottom step of the formal stoop.

The foregoing, typical state of the art examples of certain individual features differ in kind, degree, use and interrelated intent from the embodiments of my invention as shown in FIGS. 1, 2, 3, 6, 8, 9, 14 and 15: (1) the formal window group structure 84 (and similarly 84*b*) atypically combines the windows 46 (or 46*b*) of the main (first floor) level with the windows 48 (or garage door 48*b*) at the ground floor level; (2) the substantially level grade 33, which is generally at the ground floor level is purposefully and appreciably raised (33*a*) at the immediate area of formal stoop 43*a*, so that the sidewalk elevation 42*a* at the bottom step is illustratively about one and a half feet higher than the substantially level grade 33 (This is an important functional design innovation that works in conjunction with the main entrance door 32, that is at intermediate formal entry level 50, since it has a direct bearing on the number of risers required in the decorative, curved stair treatment 52); (3) this raised stoop 43*a* and main door 32, as it relates to (A) the novel formal entry 50 and foyer 56 solution, (B) the atypically combined and aligned formal window group structure 84 (or 84*b*) and (C) the novel solution of the standard service entrance door 34, to the side of and between the formal window group structure 84 (or window-garage door structure 84*b*) and the formal stoop 43*a* (and main entrance door 32), all in a novel, interrelated, critically balanced combination; represent this particular embodiment of the invention. In essence this embodiment is a 3-story front townhouse that appears to be a 2-story front townhouse for the express purpose of making the novel two separate, standard entrance door scheme in the front acceptable in appearance and acceptable psychologically as to its practical workings, in a functional and utilitarian sense.

The decorative structure 84, combining windows 46 and 48 (or 84*b*, combining windows 46*b* and garage door 48*b* in FIG. 9) may be of any suitable material and design, conventionally built into the townhouse unit.

In the townhouse unit of FIG. 3, the windows 46 are shown as formal, large, wooden, double-hung windows and the bottom windows 48 are shown as being a wood awning or wood casement type window. It will be appreciated, however, that other known types of window operating units may be utilized for these windows, as desired. The same would apply to the windows 46*b* of structure 84*b* in FIG. 9.

It will be appreciated, further, that within the basic conceptual workings of the invention, other elemental, design treatment variations for atypically large townhouses are possible, for example: (1) a formal main entrance door that instead of being a single door could instead be a two-leaf, double, main entrance door in which the leaf (or door) that is typically not used as the entrance door may be a permanently fixed door panel or it may in fact be an unlatchable, operable door; (2) a standard, service entrance door for individuals and/or a formal main entrance door that are generally recessed from the exterior face of the front wall of the townhouse unit.

AN EXPOSED, FRONT, STANDARD SERVICE DOOR TO A SERVICE, ENTRANCE CORRIDOR WITHIN THE LIMITED WIDTH CONSTRAINT OF A TYPICAL TOWNHOUSE UNIT.

In suburban and rural projects, it is typical to build a minimum number of less popular 3-story front townhouses, where site conditions offer no other alternative. The main entrance in such cases is usually preferred at the ground floor level rather than at the main floor level, which requires an exterior stair. This preference for a ground floor level entrance eliminates the possibility of a standard service door concealed under an imposing, grand stoop or stair as in the traditional solution. The consideration of such a service door in currently built 3-story front townhouses, is so remote, that even in isolated cases where there is an exterior stair to a main (first floor) entrance, such a concealed service door under the stair is rarely provided. It may be assumed that the extra effort or cost in including such a service door in the scheme is not felt warranted, since access to the rear patio door is now typically possible, even though inconvenient to use.

In view of this apparent indifference to a service door with respect to a 3-story front townhouse, it would be practically unthinkable to typically provide a front, standard service door for the current, popular, 2-story front, single family townhouse. Such a concealed service door, opening into the basement level would have to be below grade and would require an exterior stair areawell, which in turn would necessitate a protective railing at grade around the stairwell. This unlikely solution would also require an exterior drain at the bottom of the stairwell landing, which in turn would present typical water problems due to the frequent possibility of the drain being clogged by leaves and dirt. Aside from the appreciable added cost of the stair, areawell and drain and its overall detractive appearance in the front, such a solution would be undesirable and highly unlikely in view of the fact that the service door is not a necessity due to the typical existence of the rear patio door (though inconvenient to use).

With the foregoing in mind, it is understandable why builders do not currently provide a typically concealed front service door in the popular 2-story front townhouse scheme, and not even typically in the 3-story front townhouse scheme, where it is more feasible and economical to do in the traditional manner. Attempting to satisfactorily solve the complex problems of providing a standard front service door, that is neither required nor considered to be a necessity in an unconventional approach is apparently disregarded by architects and builders as being impractical, unrealistic, unnecessary and/or uneconomical.

The inventor, obviously, did not share that viewpoint. It was initially his basic desire to design a prototype townhouse unit with a concealed or essentially concealed front, standard service door in an original architectural solution, that would not resort to the traditional exterior grand stair solution; and in addition, would include a spacious, formal 2-level entrance area with a fully exposed decorative stair treatment. At that point in time, the thought of inventing an architectural solution was not considered. Architecture would hardly have seemed to him, in terms of "professionalism", to be a vehicle of patentability.

This fact alone requires an explanation of the past and present state of the profession relative to the invention: traditionally, an architect would design (architecturally and engineering wise, from sketches to completed working drawings, specifications and supervision) a structure exclusively for a client. It would be unethical and unthinkable to essentially reuse or commercialize the same structure that was designed specifically for another client. Further, it was a canon of the American Institute of Architects that an architect should not be involved or indulge (commercially) in the building process. To do so would raise the question of collusion with builders, subcontractors and suppliers to the detriment of an architect's client. For this ingrained reason it was traditionally felt to be the height of unprofessionalism for an architect to consider becoming a builder, per se.

This is no longer true. The American Institute of Architects now, if anything, encourages architects to be the developer. Architects, who were traditionally the titular head of the building process, now too frequently find themselves in recent years to be a couple of rungs down the ladder as hired hands to the developers and in the same relative position as the site, structural, mechanical and electrical engineers they once employed or hired as consultants. The question that now increasingly confronts the profession of architecture is whether to sink or swim. Many architects have decided to swim. For an architect to be a builder and in essence to be his own client is no longer considered heresy. This significant fact means that it is possible for an architect to commercialize on his own architecture. If in doing so he comes up with a novel and patentable invention, then it is in his interest to protect and patent that architectural invention. It may be presumed that in coming years such architectural, design, utility inventions will not be the rarity that such inventions now seem to be — see, for example, U.S. Pat. Nos. 579,137; 763,279; 1,692,508; 2,625,714; 3,346,997; 3,479,781 and 3,638,379.

While initial futile attempts were made by the inventor to unconventionally solve the problem (still using professional logic) of a standard, service door essentially concealed from full view in the front of a townhouse unit, such attempts proved to be impractical to the considered point of abandoning the whole idea. At that period in time, in what might be called idle, frustrated doodling, the inventor drew a partial sketch (on note-pad paper) of a 3-story front townhouse, appearing to be two stories in height, with the service door completely, centrally and blatantly exposed to view. While completely counter to his original preconceptions and professional logic, the fully exposed service door in the front of a 2-story appearing townhouse seemed to have merit. Enthused, the inventor proceeded with his novel idea for townhouses, while still remaining apprehensive of the professionally illogical and questionable solution of a detracting service door fully exposed to view in the formal limited front of a less popular 3-story front townhouse unit. The combination of an aesthetically detracting, exposed, standard service door and a less popular 3-story front townhouse was understandably of great concern to the inventor as to eventual public acceptance of such a solution. In essence he was going out on a limb in feeling that he could somehow meld the incongruity of an exposed service door with the unpopularity of a 3-story front townhouse and compensatingly conceive a novel architectural solution that would enjoy public acceptance.

Other than the gnawing apprehensive feeling of radically departing from the norm, the solution of an exposed service door within a 2-story appearing front townhouse, including a spacious 2-level formal entrance area, seemed at that time totally feasible technically and a completed, working drawing solution possible within six months time. It was not until six months or so of effort had passed that the reality of continuing and seemingly insurmountable problems of practical and economic criticality became painfully apparent. These problems related primarily to the typical and realistically demanding narrow width of a townhouse.

It is one thing to have a novel, conceptual idea expressed in graphic, preliminary generalities, and another thing to translate that conceptual idea into a viable and realistic solution. That transition took many years of concentrated effort and personal sacrifice. Though the appearance of the refined and finalized invention may belie that fact, it will be appreciated that a complex and difficult, if not seemingly insurmountable, problem remains so until it is solved. Once solved the solution seems easy to those who never solved the problem, and even more so to those who are unfamiliar with the interrelated disciplines that were involved in the step-by-step solution. In the absence of this understanding, the resulting inventive accomplishment may seem unimpressive. The fact remains, however, that there is no known 3-story townhouse that is built with the ground floor level at the approximate grade line in the front, appearing to be about two stories in height at the front and featuring, for example, two standard entrance doors for individuals in the front, each door leading to a different floor level, one being a formal main entrance door, leading to the main or middle level and opening into a spacious, two-level formal entrance area of substantially the same width throughout, with an interconnecting, fully exposed, decorative stair treatment, and the other door being a fully exposed, standard, service or convenience door, opening into a generally, centrally located service or convenience corridor at the ground floor level.

With the foregoing explanation and facts in mind, the practical difficulties encountered in solving, for example, the exposed, front standard, service door opening to a service entrance corridor within the limited width constraint of a typical townhouse unit will now be explained.

Aside from the major problems previously described in this specification, the standard, service entrance door and the corridor to which it opens at the ground floor level, as width elements, represented another difficult problem that had to be resolved. In essence, the problem was a matter of adding to something that was so restrictively narrow at the outset (a typical townhouse unit), that it practically precluded the inclusion of an exposed standard service door and service corridor. This extreme narrowness can be appreciated by the following comparison: A typical home as a detached, free standing entity represents low density, single family housing. Conversely, a typical townhouse as an attached structure joined to other such structures by common sidewalls to form a contiguous group represents high density, single family housing. Consequently, the average width of a typical detached home (2-story; split level; and 1-story ranch) is 40–80 feet wide. Whereas, the average width of a typical townhouse is 18–24 feet wide. As such, the typical home is 2–3 times wider than the typical townhouse.

Having such a significant design constraint, it is typical in the state of the art (both historic and present) that the windows and the main door fenestration treatment in the front of a townhouse are constricted with respect to their horizontal spacing from each other. As a result, the typical blank wall space horizontally between the main door, or door and stoop, and the formal, large windows, or windows and garage door, is too minimal in width to be obviously conceived by a professional as a potentially usable and functional wall area. Attempting to insert an admittedly unessential (though desirable) standard service door in such a hitherto, unlikely, centrally, sensitively exposed and constricted location, seemed not only to be aesthetically and logically questionable from a professional standpoint, but impossible to do from a construction standpoint. It thus required technical ingenuity, perserverance and inventiveness to locate the standard service door, and related service corridor, in that minimal, generally central and exposed wall area location and plan location for the corridor, and do so in such a way as to functionally work in a practical sense and be aesthetically acceptable as well.

The initial, basic solution to this problem was to move the typical townhouse windows on the side opposite to the main entrance door, at all three floor levels, closer to the common sidewall between townhouse units on that said side (which would make these windows slightly off center to the room at the front of the townhouse unit). In essence, this makes the central blank wall space wider to receive the standard, service entrance door. This inclusion of the service door results in the creation of additional, critical, seemingly insurmountable problems as will be explained.

Referring now to FIGS. 3, 6, and 8, the specific requirements to resolve the service door problems were: (1) not only to move windows 44, 46 and 48 slightly to the left, as explained, but to make windows 46 and 48 (or structure 84) slightly narrower than may be typical at the main floor level. Narrowing windows **46*b* in FIG. 9, on the other hand, was impossible to do since by necessity, being aligned and combined, they had to be about 8 feet wide, the typical width of garage door 48*b*. For this reason, in the garage design variations of the invention, windows 46*b* are decidedly off center to the main floor, front room. (This 8 foot minimum width of windows 46*b* intensified solving the service entrance, standard door problem aesthetically and functionally in elevation and plan for that particular design variation); (2) to make the standard service door 34 slightly narrower in width than may be typical for a secondary entrance door. That the standard door 34 and windows 46 and 48 may be slightly and subtly narrower in width than may be typical, should in no way detract from the intended uses of these structures or from the overall appearance at the front of the townhouse. Furthermore, in townhouses with wider front elevations, the service door 34 and window structure 84** could be enlarged in width as desired.

Examples of the technical, critical construction difficulties encountered in this standard service door entrance scheme may be seen in FIG. 3 (the following discussion being equally applicable to FIGS. 9 – 13, as will be evident):

1. By purposefully making the central blank wall area 15 wider to receive the standard service door 34, the very inclusion of door 34 creates additional narrow blank wall spaces and openings of varied widths (for example, at section line 5—5 of FIG. 3) than is typical. These wall spaces and openings are numbered respectively: 11; 48; 12; 34; 13; 32; and 14. To make the solution realistically practical it meant that all these various width, blank wall spaces and openings, when typically using brick as an exterior wall finish material, had to be in standard, horizontal brick and joint coursing, which in turn had to match standard brick and joint coursing for the entire width of the townhouse, for example, the solid wall between the first and second floor levels. This is done so as to avoid costly and unsightly cutting of standard length brick. Naturally, the narrower the blank wall spaces and openings, the fewer the variable thickness of the vertical brick joints involved (e.g. ¼ inch; ⅜ inch; ½ inch; and ⅝ inch) to properly adjust to standard horizontal coursing for the solids and voids, which in turn made the dimensional solution more difficult — all of this due to the novel inclusion of the standard, service door 34;

2. To be realistically practical the windows 46 and 48 (or **46*b* and garage door 48*b*) and doors 34 and 32** had to be in stock sizes, which further reduced the variables in dimensional width to adjust to brick and joint horizontal coursing;

3. It may be appreciated that the plan detail at wall 12, involving door 34, window 48 (or garage door **48*b*) and service entrance corridor wall 73 (in FIG. 5**) was particularly difficult to resolve with the horizontal brick coursing dimensions involved.

These are but three common examples that illustrate in part the extremely tight horizontal tolerances that were involved in the invention, due essentially to the constrictive width of a typical townhouse. When a service door is concealed under a stoop, as in the historical townhouse solution, these extremely tight tolerances (due to increased solids and voids resulting from an exposed service door in a 2-story front appearing townhouse) do not exist — nor do they exist (in such an extreme sense) in current townhouses, since no known townhouse has a novel, exposed and generally centrally located standard service door (and entrance corridor) in the front of a 2-story appearing townhouse in which the service door and the formal, main entrance door lead to different floor levels of the townhouse unit, and which create the foregoing problems.

To have some intelligible understanding of the preceding statements of criticality, a horizontal brick coursing dimension table for standard size brick is reproduced hereinbelow. (Ramsey & Sleeper, *Architectural Graphic Standards,* John Wiley & Sons, Inc., publishers, New York, N.Y., 5th Edition 1957, 668 pages, p. 80.)

HORIZONTAL BRICK COURSES

| # OF BRICKS & JOINTS | LENGTH OF COURSE | | | | |
|---|---|---|---|---|---|
| | ¼" Joints | ⅜" Joints | ½" Joints | ⅝" Joints | ¾" Joints |
| 1 brk. & 0 jt. | 0'-8" | 0'-8" | 0'-8" | 0'-8" | 0'-8" |
| * 1½ brks. & 1 jt. | 1'-0¼" | 1'-0⅜" | 1'-0½" | 1'-0⅝" | 1'-0¾" |
| 2 brks. & 1 jt. | 1'-1¼" | 1'-1⅜" | 1'-1½" | 1'-1⅝" | 1'-1¾" |
| 2½ brks. & 2 jts. | 1'-6½" | 1'-6¾" | 1'-9" | 1'-9¼" | 1'-9½" |
| 3 brks. & 2 jts. | 2'-0½" | 2'-0¾" | 2'-1" | 2'-1¼" | 2'-1½" |
| 3½ brks. & 3 jts. | 2'-4¾" | 2'-5⅛" | 2'-5¼" | 2'-5⅞" | 2'-6¼" |
| * 4 brks. & 3 jts. | 2'-8¾" | 2'-9⅞" | 2'-9½" | 2'-9⅞" | 2'-10¼" |
| 4½ brks. & 4 jts. | 3'-1" | 3'-1½" | 3'-2" | 3'-2½" | 3'-3" |
| 5 brks. & 4 jts. | 3'-5" | 3'-6½" | 3'-6" | 3'-6½" | 3'-7" |
| * 5½ brks. & 5 jts. | 3'-9¼" | 3'-9⅞" | 3'-10½" | 3'-11⅛" | 3'-11¾" |
| 6 brks. & 5 jts. | 4'-1¼" | 4'-1⅞" | 4'-2½" | 4'-3⅛" | 4'-3¾" |
| 6½ brks. & 6 jts. | 4'-5½" | 4'-6¼" | 4'-7" | 4'-7¾" | 4'-8½" |
| 7 brks. & 6 jts. | 4'-9½" | 4'-10¼" | 4'-11" | 4'-11¾" | 5'-0½" |
| 7½ brks. & 7 jts. | 5'-1¾" | 5'-2⅝" | 5'-3½" | 5'-4⅜" | 5'-5¼" |
| 8 brks. & 7 jts. | 5'-5¾" | 5'-6⅝" | 5'-7½" | 5'-8⅜" | 5'-9¼" |
| 8½ brks. & 8 jts. | 5'-10" | 5'-11" | 6'-0" | 6'-1" | 6'-2" |
| 9 brks. & 8 jts. | 6'-2" | 6'-3" | 6'-4" | 6'-5" | 6'-6" |
| 9½ brks. & 9 jts. | 6'-6¼" | 6'-7⅜" | 6'-8½" | 6'-9⅝" | 6'-10¾" |
| 10 brks. & 9 jts. | 6'-10¼" | 6'-11⅜" | 7'-0½" | 7'-1⅝" | 7'-2¾" |
| 10½ brks. & 10 jts. | 7'-2½" | 7'-3¾" | 7'-5" | 7'-6¼" | 7'-7½" |
| 11 brks. & 10 jts. | 7'-6½" | 7'-7¾" | 7'-9" | 7'-10¼" | 7'-11½" |
| 11½ brks. & 11 jts. | 7'-10¾" | 8'-0⅞" | 8'-1½" | 8'-2⅞" | 8'-4¼" |
| 12 brks. & 11 jts. | 8'-3" | 8'-4⅛" | 8'-5½" | 8'-6⅞" | 8'-8¼" |
| 12½ brks. & 12 jts. | 8'-7" | 8'-8½" | 8'-10" | 8'-11½" | 9'-1" |
| 13 brks. & 12 jts. | 8'-11" | 9'-0½" | 9'-2" | 9'-4½" | 9'-6" |
| 13½ brks. & 13 jts. | 9'-3¼" | 9'-4⅞" | 9'-6½" | 9'-8⅛" | 9'-9¾" |
| 14 brks. & 13 jts. | 9'-7¼" | 9'-8⅞" | 9'-10½" | 10'-0⅞" | 10'-3¼" |
| * 14½ brks. & 14 jts. | 9'-11½" | 10'-1¼" | 10'-3" | 10'-4¾" | 10'-6½" |
| 15 brks. & 14 jts. | 10'-3½" | 10'-5¼" | 10'-7" | 10'-8¾" | 10'-10½" |
| 15½ brks. & 15 jts. | 10'-7¾" | 10'-9⅝" | 10'-11½" | 11'-1⅜" | 11'-3¼" |
| 16 brks. & 15 jts. | 10'-11¾" | 11'-1⅝" | 11'-3½" | 11'-5⅜" | 11'-7¼" |
| 16½ brks. & 16 jts. | 11'-4" | 11'-6" | 11'-8" | 11'-10" | 12'-0" |
| 17 brks. & 16 jts. | 11'-8" | 11'-10" | 12'-0" | 12'-2" | 12'-4" |
| 17½ brks. & 17 jts. | 12'-0¼" | 12'-2⅜" | 12'-4½" | 12'-6⅝" | 12'-8¾" |
| 18 brks. & 17 jts. | 12'-4¼" | 12'-6⅜" | 12'-8½" | 12'-10⅝" | 13'-0¾" |
| 18½ brks. & 18 jts. | 12'-8½" | 12'-10¾" | 13'-1" | 13'-3¼" | 13'-5½" |
| 19 brks. & 18 jts. | 13'-0½" | 13'-2¾" | 13'-5" | 13'-7¼" | 13'-9½" |
| 19½ brks. & 19 jts. | 13'-4¾" | 13'-7⅛" | 13'-9½" | 13'-11⅞" | 14'-2¼" |
| 20 brks. & 19 jts. | 13'-8¾" | 13'-11⅛" | 14'-1½" | 14'-3⅞" | 14'-6¼" |

HORIZONTAL BRICK COURSES—Continued

| # OF BRICKS & JOINTS | LENGTH OF COURSE | | | | |
|---|---|---|---|---|---|
| | ¼" Joints | ⅜" Joints | ½" Joints | ¾" Joints | ¾" Joints |
| 20½ brks. & 20 jts. | 14'-2" | 14'-3½" | 14'-6" | 14'-8½" | 14'-11" |
| 21 brks. & 20 jts. | 14'-6" | 14'-7½" | 14'-10" | 15'-0½" | 15'-4" |
| 21½ brks. & 21 jts. | 14'-9¼" | 14'-11⅞" | 15'-2½" | 15'-5⅛" | 15'-7¾" |
| 22 brks. & 21 jts. | 15'-1¼" | 15'-3⅞" | 15'-6½" | 15'-9⅛" | 15'-11¾" |
| 22½ brks. & 22 jts. | 15'-4½" | 15'-8¼" | 15'-11" | 16'-3⅛" | 16'-6¼" |
| 23 brks. & 22 jts. | 15'-8¼" | 16'-0⅞" | 16'-3" | 16'-6⅛" | 16'-9½" |
| 23½ brks. & 23 jts. | 16'-1¾" | 16'-4⅝" | 16'-7½" | 16'-10⅜" | 17'-1¼" |
| 24 brks. & 23 jts. | 16'-5¼" | 16'-8⅝" | 16'-12½" | 17'-2⅛" | 17'-5¾" |
| 24½ brks. & 24 jts. | 16'-9" | 17'-1" | 17'-4" | 17'-7" | 17'-10" |
| 25 brks. & 24 jts. | 17'-2" | 17'-5" | 17'-9" | 17'-11" | 18'-2" |
| 25½ brks. & 25 jts. | 17'-6¼" | 17'-9⅜" | 18'-3½" | 18'-6⅝" | 18'-9¾" |
| 26 brks. & 25 jts. | 17'-10¼" | 18'-1⅜" | 18'-4½" | 18'-7⅝" | 18'-10¾" |
| 26½ brks. & 26 jts. | 18'-3¼" | 18'-6¼" | 18'-9" | 19'-0¼" | 19'-3½" |
| 27 brks. & 26 jts. | 18'-6½" | 18'-9¾" | 19'-1" | 19'-4¼" | 19'-7½" |
| 27½ brks. & 27 jts. | 18'-10¾" | 19'-2⅜" | 19'-6½" | 19'-8⅞" | 20'-0¼" |
| 28 brks. & 27 jts. | 19'-2¾" | 19'-6⅛" | 19'-9½" | 20'-0⅞" | 20'-4" |
| 28½ brks. & 28 jts. | 19'-7" | 19'-10½" | 20'-2" | 20'-6½" | 20'-9" |
| 29 brks. & 28 jts. | 19'-11" | 20'-2½" | 20'-6" | 20'-9½" | 21'-1" |
| 29½ brks. & 29 jts. | 20'-3¼" | 20'-6⅞" | 20'-10½" | 21'-2⅛" | 21'-5¾" |
| 30 brks. & 29 jts. | 20'-7¼" | 20'-10⅞" | 21'-2½" | 21'-6⅛" | 21'-9¾" |
| 30½ brks. & 30 jts. | 20'-11½" | 21'-3¼" | 21'-7" | 21'-10¼" | 22'-2½" |
| 31 brks. & 30 jts. | 21'-3½" | 21'-7¼" | 21'-11" | 22'-2¾" | 22'-6½" |
| 31½ brks. & 31 jts. | 21'-7¼" | 21'-11⅜" | 22'-3½" | 22'-7⅜" | 22'-11¼" |
| 32 brks. & 31 jts. | 21'-11¼" | 22'-3⅞" | 22'-7½" | 22'-11⅜" | 23'-3¼" |
| 32½ brks. & 32 jts. | 22'-4" | 22'-8" | 23'-0" | 23'-4" | 23'-8" |
| 33 brks. & 32 jts. | 22'-8" | 23'-0" | 23'-4" | 23'-8" | 24'-0" |
| 33½ brks. & 33 jts. | 23'-0¼" | 23'-4⅜" | 23'-8½" | 24'-0⅜" | 24'-4⅝" |
| 34 brks. & 33 jts. | 23'-4¼" | 23'-8⅜" | 24'-0½" | 24'-4⅝" | 24'-8¾" |
| 34½ brks. & 34 jts. | 23'-8½" | 24'-0¾" | 24'-5" | 24'-9¼" | 25'-1½" |
| 35 brks. & 34 jts. | 24'-0½" | 24'-4¾" | 24'-9" | 25'-1¼" | 25'-5½" |
| 35½ brks. & 35 jts. | 24'-4¾" | 24'-9⅛" | 25'-1½" | 25'-5⅞" | 25'-10¼" |
| 36 brks. & 35 jts. | 24'-8¾" | 25'-1½" | 25'-6½" | 25'-9⅞" | 26'-2¼" |
| 36½ brks. & 36 jts. | 25'-1" | 25'-5½" | 25'-10" | 26'-2⅜" | 26'-7" |
| 37 brks. & 36 jts. | 25'-5" | 25'-9½" | 26'-2" | 26'-6½" | 26'-11" |
| 37½ brks. & 37 jts. | 25'-9¼" | 26'-1⅞" | 26'-6½" | 26'-11⅛" | 27'-3¾" |
| 38 brks. & 37 jts. | 26'-1¼" | 26'-5⅞" | 26'-10½" | 27'-3½" | 27'-7¾" |
| 38½ brks. & 38 jts. | 26'-5½" | 26'-10¼" | 27'-3" | 27'-7¾" | 28'-0½" |
| 39 brks. & 38 jts. | 26'-9½" | 27'-2¼" | 27'-7" | 27'-11¾" | 28'-4½" |
| 39½ brks. & 39 jts. | 27'-1¾" | 27'-6⅜" | 27'-11½" | 28'-4⅜" | 28'-9½" |
| 40 brks. & 39 jts. | 27'-5¾" | 27'-10⅝" | 28'-3½" | 28'-8⅜" | 29'-1¼" |
| 40½ brks. & 40 jts. | 27'-10" | 28'-3" | 28'-8" | 29'-1" | 29'-6" |
| 41 brks. & 40 jts. | 28'-2" | 28'-7" | 29'-0" | 29'-5" | 29'-10" |
| 41½ brks. & 41 jts. | 28'-6¼" | 28'-11⅞" | 29'-4½" | 29'-9⅞" | 30'-2¾" |
| 42 brks. & 41 jts. | 28'-10¼" | 29'-3⅞" | 29'-8½" | 30'-1⅞" | 30'-6¾" |
| 42½ brks. & 42 jts. | 29'-2¾" | 29'-7¼" | 30'-1" | 30'-6¼" | 30'-11¼" |
| 43 brks. & 42 jts. | 29'-6½" | 29'-11⅞" | 30'-5" | 30'-10¼" | 31'-3½" |
| 43½ brks. & 43 jts. | 29'-10¾" | 30'-4⅛" | 30'-9¼" | 31'-2⅞" | 31'-8¼" |
| 44 brks. & 43 jts. | 30'-2¾" | 30'-8⅛" | 31'-1½" | 31'-6⅞" | 32'-0¼" |
| 44½ brks. & 44 jts. | 30'-7" | 31'-0½" | 31'-6" | 31'-11½" | 32'-5" |
| 45 brks. & 44 jts. | 30'-11" | 31'-4½" | 31'-10" | 32'-3½" | 32'-9" |
| 45½ brks. & 45 jts. | 31'-3¼" | 31'-8⅞" | 32'-2½" | 32'-8⅛" | 33'-1¾" |
| 46 brks. & 45 jts. | 31'-7¼" | 32'-0⅞" | 32'-6½" | 33'-0⅛" | 33'-5¾" |
| 46½ brks. & 46 jts. | 31'-11½" | 32'-5⅞" | 32'-11" | 33'-4¾" | 33'-10½" |
| 47 brks. & 46 jts. | 32'-3½" | 32'-9¼" | 33'-3" | 33'-8¼" | 34'-2½" |
| 47½ brks. & 47 jts. | 32'-7¾" | 33'-1⅜" | 33'-7½" | 34'-1⅜" | 34'-7¼" |
| 48 brks. & 47 jts. | 32'-11¾" | 33'-5⅜" | 33'-11½" | 34'-5⅜" | 34'-11¼" |
| 48½ brks. & 48 jts. | 33'-4" | 33'-10" | 34'-4" | 34'-10" | 35'-4" |
| 49 brks. & 48 jts. | 33'-8" | 34'-2" | 34'-8" | 35'-2" | 35'-8" |
| 49½ brks. & 49 jts. | 34'-0¼" | 34'-6⅜" | 35'-0½" | 35'-6⅜" | 36'-0¼" |
| 50 brks. & 49 jts. | 34'-4¼" | 34'-10⅜" | 35'-4½" | 35'-10⅜" | 36'-4¼" |
| 50½ brks. & 50 jts. | 34'-8½" | 35'-2¾" | 35'-9" | 36'-3¼" | 36'-9½" |
| 51 brks. & 50 jts. | 35'-0½" | 35'-6¼" | 36'-1" | 36'-7¼" | 37'-1½" |
| 51½ brks. & 51 jts. | 35'-4¾" | 36'-1⅛" | 36'-5½" | 36'-11⅞" | 37'-6¼" |
| 52 brks. & 51 jts. | 35'-8¾" | 36'-3⅛" | 36'-9½" | 37'-3⅞" | 37'-10¼" |
| 52½ brks. & 52 jts. | 36'-1" | 36'-7½" | 37'-2" | 37'-8½" | 38'-3" |
| 53 brks. & 52 jts. | 36'-5" | 36'-11½" | 37'-6" | 38'-0½" | 38'-7" |
| 53½ brks. & 53 jts. | 36'-9¼" | 37'-3⅞" | 37'-10½" | 38'-5⅛" | 38'-11¾" |
| 54 brks. & 53 jts. | 37'-1¼" | 37'-7⅞" | 38'-2½" | 38'-9⅛" | 39'-3¾" |
| 54½ brks. & 54 jts. | 37'-5½" | 38'-0¼" | 38'-7" | 39'-1⅜" | 39'-8½" |
| 55 brks. & 54 jts. | 37'-9½" | 38'-4¼" | 38'-11" | 39'-5⅜" | 40'-0½" |
| 55½ brks. & 55 jts. | 38'-1¾" | 38'-8⅝" | 39'-3½" | 39'-10⅜" | 40'-5¼" |
| 56 brks. & 55 jts. | 38'-5¾" | 39'-0⅝" | 39'-7½" | 40'-2⅜" | 40'-9¼" |
| 56½ brks. & 56 jts. | 38'-10" | 39'-5" | 40'-0" | 40'-7" | 41'-2" |
| 57 brks. & 56 jts. | 39'-2" | 39'-9" | 40'-4" | 40'-11" | 41'-6" |
| 57½ brks. & 57 jts. | 39'-6¼" | 40'-1⅜" | 40'-8½" | 41'-3⅜" | 41'-10½" |
| 58 brks. & 57 jts. | 39'-10¼" | 40'-5⅜" | 41'-0½" | 41'-7⅜" | 42'-2½" |
| 58½ brks. & 58 jts. | 40'-2½" | 40'-9¼" | 41'-5⅝" | 42'-0¼" | 42'-7½" |
| 59 brks. & 58 jts. | 40'-6½" | 41'-1¾" | 41'-9" | 42'-4¼" | 42'-11½" |
| 59½ brks. & 59 jts. | 40'-10½" | 41'-6⅛" | 42'-1½" | 42'-8⅛" | 43'-4¼" |
| 60 brks. & 59 jts. | 41'-2¾" | 41'-10⅛" | 42'-5½" | 43'-0⅛" | 43'-8¼" |

EXAMPLE OF USE (WITH ¼" JOINTS)

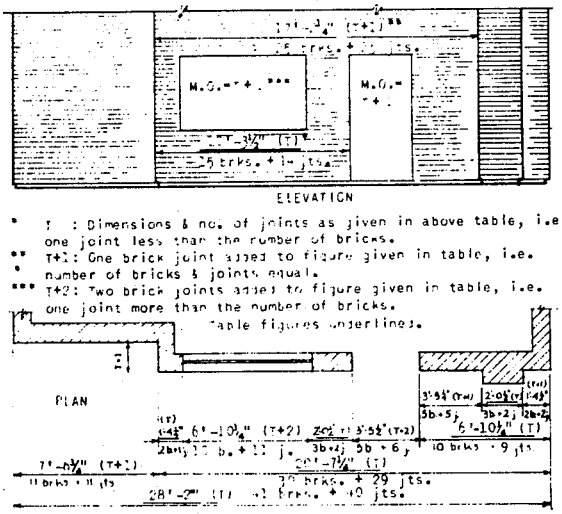

* T : Dimensions & no. of joints as given in above table, i.e. one joint less than the number of bricks.

** T+1: One brick joint added to figure given in table, i.e. number of bricks & joints equal.

*** T+2: Two brick joints added to figure given in table, i.e. one joint more than the number of bricks.

Table figures underlined.

*References cited in this specification.

As can be seen in the horizontal brick coursing table, above, the fewer the constant sized bricks and variable thick joints (from ¼ inch to ¾ inch), the less dimensional "tolerance" there is in the "length of course". (It should be noted that a ¾ inch thick vertical brick joint, the last column, is generally unacceptably thick — the thicker the joint the greater the chance of mortar joint shrinkage, which can cause leaks through the wall.) For example, it should be noted that one of the greatest width of walls at section line 5—5 in FIG. 3 is wall 11, which is only, for example, 5-½ bricks and 5 joints wide (for example, 3 feet - 9-½ inches), where the total horizontal tolerance in length of course is only 2-½ inches (this would be true for a townhouse that would be, for example, 24 feet wide). In narrower townhouses, for example, 20 feet wide that same wall 11 would only be, for example, 4 bricks and 3 joints wide (for example, 2 feet - 9-½ inches), where the total horizontal tolerance in length of course is only 1-½ inches. By the same token, wall 12 (which is the same in width for all typical width models) is, for example, only 1-½ bricks and 1 joint wide (for example, 1 foot - 0-½ inches), where the total horizontal tolerance in length of course is only ½ inch. Parenthetically, on the other hand, for a wall that is 14-½ bricks and 14 joints wide (about 10 feet), the total horizontal tolerance in the length of course would be as much as 7 inches.

It will be appreciated from the foregoing examples that the increased narrow walls (and opening 34), for example, at section line 5—5 of FIG. 3, created by the exposed inclusion of standard, service door 34 (and the fact that wall 11 is made narrower by that inclusion as well, due to the off center placement of window structure 84) represent formidable, horizontal, dimensional, tolerance problems, which would not be as constrictively critical if service door 34 was not fully exposed in the front of the townhouse as in the invention. This fact is equally valid, regardless of the exterior finish material, such as wood, used in the construction of the inventor's townhouses. While the example of horizontal brick coursing was used to demonstrate the additional, realistic, critical dimensional problems involved, the dictates of practicality and economy would necessitate similar adherence to manufactured stock sizes of any exterior finish material used, where this additional critical factor of dimensional restrictiveness would remain substantially comparable.

Having explained typical front elevation problems, resulting from the inclusion of the standard, service door within the constructive width of a townhouse, the related problems in plan with respect to the generally centrally located service corridor, will now be explained: It is typical in the state of the art that townhouses by their very function, as a high density form of single family housing, are constrictively narrow. Generally, this in turn results in room sizes that are narrow and long. In essence, this fact accounts for the main entrance area to be typically at one extreme side, since doing so allows for a maximum width for the room or rooms on the remaining side. This solution, especially as it relates to ths historic townhouse, accounts for the logical, functional location of the concealed service door under the stoop, since aside from aesthetic advantages, it allowed for the service entrance corridor to be at one extreme side of the ground floor plan, which in turn allowed for maximum width for the room or rooms on the remaining side. For this reason it would not be professionally logical to seemingly complicate planning problems by generally bisecting (with a corridor) the main and ground floor plan areas of a typical townhouse which is inherently constrictively narrow at the onset. An exception to this fact would be an a typically wide townhouse.

Referring now to FIGS. 5, 14 and 15, the service entrance corridor 72 at the ground floor level is shown generally centrally located, which is a typical for a townhouse. Furthermore, while it is a typical to have corridor 72 in a generally central location, it is novel to have corridor 72 terminate at the front wall, whereby it functions as a service entrance to a standard service door 34 as in this invention.

One particularly troublesome construction, detailing problem relating to corridor 72 concerned corridor steps 79 and the elevation of grade 33 at service door 34. While it is preferable to have the ground floor level (which is coincident with corridor 72) at the same or substantially the same elevation as grade 33, it is equally preferable, if not mandatory, to have service door 34 one step above grade. This step 78 effectively prevents rain and melting snow from seeping inside, under the door. To have door 34 one step above grade (if grade and the ground floor level are at the same or substantially the same elevation) would require a corresponding step down in corridor 72. However, since one step, other than at an entrance door, is considered to be a safety (tripping) hazard, two steps are the minimum required by the codes. Having two steps 79 in corridor 72, correspondingly required that grade 33 at the immediate area of service door 34 be raised the equivalent of one step or approximately an additional 6 inches above the ground floor level. For that reason there is one step 78 up at door 34, and two steps 79 down in corridor 72.

Alternatively, to have solved the service door and corridor problem without having the two steps 79 in corridor 72, would have meant that grade 33 would have been approximately 6 inches below the ground floor or corridor level to allow one step above grade at service door 34. This in turn would have meant that grade 33, at door 34, instead of being approximately 6 inches above the ground floor level as it is now, would have been 6 inches below, or approximately 12 inches lower than what is now indicated. Had this been the case, the angle of grade 33*a,* starting at service door 34, to the base of stoop 43*a,* would have been too steep for practical and functionally aesthetic purposes. This would have also had the essential effect of stoop 43*a* being raised too high above grade 33. To have compensated for this condition by lowering stoop 43*a* six inches or one foot, and adjusting the angle of grade 33*a* accordingly, would have correspondingly lowered the sunken formal entry 50 by the same amount, which would have required an additional one or two risers in decorative stair 52. Alternatively, had stoop 43*a* remained fixed instead, it would have required the addition of one or two steps to stoop 43*a,* and adjusting the angle of grade 33*a* accordingly, which would have then made the stoop bigger than desired for the subtle effects required. After having tried all these various combinations and possibilities, it was determined in the end that the present solution, requiring two steps 79 in corridor 72, resulted in the most subtle, practical and functionally aesthetic combination possible, for the related functional design elements in the novel standard, service door and corridor, and the formal main entrance door scheme.

Another practicularly troublesome planning and construction detailing problem relating to corridor 72 concerned window 48. While it would have been preferred to have window 48 more centrally located in wall 85, to do so would have had the opposite effect upon window 46 (in FIGS, 4 and 6) at the main floor level, since the windows 46 and 48 are aligned and combined in window structure 84, which is part of the 2-story appearing embodiment of the invention. For that reason the intersection of window 48, wall 73 and door 34 was difficult to resolve, especially as this detail related to extremely restrictive horizontal brick and joint standard coursing dimensions. It is believed that the location of window 48 to one extreme side of wall 85 will not detract from the uses of room 75.

Finally, aside from the foregoing problems, it may be appreciated that there were heating-air conditioning ductwork and structural framing problems related to the inclusion of service corridor 72 as well, and the fact that it terminates in a central location at the front exterior wall of the townhouse.

Summarizing the Details of the Two Separate, Standard Entrance Door Scheme, Including Related Site Detils Not Previously Explained The invention in its final form was the result of many distinct stages of development and refinement, requiring an effort that extended over a number of years. If there was one key factor that could be singled out as leading to the final stage and refined solution, then it was the elimination of one riser from the main stair. To understand the significance of this statement requires an explanation regarding the state of the art in present townhouses: (1) the typical floor-to-ceiling height is nominally 8 feet; (2) typically there are 14 stair risers floor-to-floor; (3) 14 stair risers allow a floor joint size range from 2 in. × 8 in. to 2 in. × 14 in. (with 2 in. × 10 in. being the most typically used size), which represents a riser height range from about 7 ½ in. to 8 in.

(FHA and BOCA code allow a maximum riser height of 8¼ in.). It is understandable then, that the invention was initially based on 2 in. × 10 in. joists and on this typical criteria of 14 risers floor-to-floor.

One of the basic problems of the invention relating to all of its embodiments, was in essence how to break down the required 14 risers into subtle incremental stages for the purpose of motivating a person from grade, which is generally at the ground floor level, to the main (first floor) level, without his climbing the bulk of these risers continuously on the outside of a townhouse unit — the traditional historic solution. These breakdown stages were studied and refined continuously in an attempt to determine exactly the right subtle combination to make the 2-story front scheme and 2-level formal entrance area work. To achieve the overall desired result of the invention it was important: (1) that the angle of grade 33*a*, starting at service door 34 to the base of stoop 43*a* should not be too steep; (2 ) that the number of steps and size of stoop 43*a* be minimal; (3) that the number of steps in decorative stair 52 be minimal; (4) that the main U stair 68 be as compact as possible to achieve the desired, spacious 2-level formal entrance area without sacrificing the size of other room areas; and (5) to resolve these problems practically and economically.

While the invention in development for years worked with 14 risers floor-to-floor, it was felt to be at its upper limit of aesthetic or psychological acceptability for the 2-story appearance, and much too demanding in its vertical tolerances in a site requirement sense, as will become evident. Faced with this latter impracticality, the structural framing system, and mechanical ductwork system, were totally reevaluated and a less typical nominal joist size of 2 in. × 8 in. was established for all floor levels. Not only did the resulting atypical, wall bearing, structural framing system turn out to be more economical and practical, but it eliminated one stair riser for a resulting total of 13 risers floor-to-floor, which in turn eased vertical tolerances immeasurably.

The significance and importance of eliminating the one riser may be appreciated by the following summary explanation of the inventive entrance scheme as shown in FIGS. 1,6,8,14 and 15. By subtly raising the slope of entrance walk 36 from sidewalk 38 until it reaches its highest elevation 42*a* at the bottom step or stoop 43*a* (at which elevation the raised walk or stoop has absorbed the equivalent of three interior risers above the ground floor level), it is in that manner possible to keep the number of steps in stoop 43*a* to a minimum (but in so doing it required 2 steps 79 in corridor 72, as previously explained). This in turn keeps the overall size of stoop 43*a* to a minimum, which desirably makes it appear that stoop 43*a* is primarily there for aesthetically formal, design reasons only. Contrary to that intended impression, the raised stoop 43*a* (and 2 steps in corridor 72) actually allows for a minimum number of risers in decorative, curved stair 52, that interconnects the 2 -level forml entrance area. As a result, decorative stair 52, as with stoop 43*a* does not appear formidable to climb, but to the contrary, seems to be there (including the 2-level effect) for aesthetic reasons only.

Thus, the instant a person steps on to entrance walk 36 from sidewalk 38, he is totally unaware that, in reality, he is actually starting a subtle ascent to the main (first floor) level, without the need of climbing a continuous and tiresome outside flight of steps. By the time he reaches the bottom step of stoop 43*a* he has walked the equivalent of 3 interior risers above the ground floor level. Similarly, the instant a person walks on to service walkway 40, from entrance walk 36, he is in a sense descending to the ground floor level, access to which is provided by standard service door 34. It should be particularly noted that this distinct and novel separate entrance scheme, as described, is exactly the same whether the optional front room 75 at the ground floor level is a bedroom or a garage.

In the foregoing detailed description it should be understood that the desirable maximum gradient or percent of slope for entrance walk 36, as it subtly rises to stoop 43*a*, is 5% - 6%. Also, grade at the front of the townhouse unit would slope down and away for proper drainage at about a ⅛ in. - ¼ in. per foot. Assuming the front lawn to be about 35 feet deep (as shown in FIGS. 1 and 2), then the low point of entrance walk 36, where it meets sidewalk 38, would be an additional 6 inches ± lower or about 2 feet below point 42*a* at the bottom step or stoop 43*a*. If, because of restrictive site conditions, the front lawn setback was only about 15 feet deep, then to keep the gradient of walk 36 reasonable, the following corrective design solution could be employed to subtly reach the required sidewalk elevation at 42*a*: at the transition from the main sidewalk 38 to the entrance walk 36, two steps could be introduced at that location (with the entrance walk gradient adjusted or leveled as required) to compensate for the abbreviated setback condition. It is believed that these possible initial "walkway" steps would in no way detract from the intended subtle ascent procedure as previously described.

It may be appreciated from this summary description that, not only were the horizontal tolerances critical, due to the constrictive width of a townhouse, but the vertical tolerances, to achieve the 2-story front appearance including the service and formal entrance schemes, were equally critical.

Thus, one of the overriding novel intents of the invention was to make it appear that the exterior and interior design of the townhouse was based entirely on aesthetic considerations. The reality of a precise utilitarian scheme for functional intent was to be made totally unrecognizable. As such, the specific, elemental design component parts or workings of the utilitarian design invention had to be linked together and blended in such a manner that the novel relationship was unobvious. It is the height of irony that this effort in subtly fitting the parts together was so relentlessly pursued over the years, the final refined inventive solution belies the unobvious critically involved accomplishment! The difficulties and complexities that actually existed, the seemingly unsolvable, practical horizontal and vertical tolerances, the totally unobvious rationale to overcome the seemingly, professionally illogical objectives, the seemingly endless trail and error juxtapositioning of the design elements in elevation and plan, the constant revisions and refinement; are all capable of being unrecognized and unappreciated in hindsight by the very success of the inventive workings. What appears to be a simple solution was the result of painstaking, tireless, and persevering effort, that was in no way obvious.

ENTRANCE SCHEME VARIATIONS

It will be appreciated that variations of the invention just described, and within the scope of the following claims, would be obvious to those skilled in the townhouse building arts. For example, as shown in FIGS. 10 and 13, the position of the main door 32*c*, 32*d* and standard service door 34c, 34d at the front may be changed, especially for atypically larger and wider townhouses, whereby the main door may be in the middle rather than to one side; and the bottom service door may be made narrower or wider as design considerations indicate. Further, at the main (first floor) level, as shown in FIG. 11, there would be in addition to the typical kitchen, dining and living room arrangements (not shown), an extra room 89 that could be used for example as a den, study or guest room. The 2-level formal entrance area, shown in this case to be generally centrally located, remains conceptually the same as previously described in detail with the following variations: (1) decorative stair 52c, interconnecting "sunken" formal entry 50c and upper foyer 56c is shown on the opposite side; (2) conventional closet 58c and powder room 66c are shown on the opposite side, both opening to circulation area 69c which is coincident (or substantially coincident) with the landing area of main stairway 68c. It will be appreciated that in other plan variations, either closet 58c or powder room 66c or both could open into the upper foyer 56c, if desired.

At the ground floor level, as shown in FIG. 12, standard service door 34c opens into generally, centrally located service entrance corridor 72c, as also previously described in detail. Since there is more available area at the ground floor level in such larger and wider townhouses, designated storage and utility areas become more versatile or interchangeable in use. For example: (1) room 76c under formal entry 50c could be a mechanical room or storage room; (2) room 98c under main stairway 68c could be a mechanical or storage room; (3) room 99 could be a hobby work and/or storage room or a laundry and/or sewing room; and (4) room 75c as previously described would still remain, for example, an optional habitable room such as a bedroom or it could be a garage. In view of this latter fact window 48c as shown in FIG. 10 could instead be a garage door 48d as shown in FIG. 13.

Conventional sliding or swinging doors 80c are shown arranged at the rear of the ground floor level (FIG. 12) in wall 81c and opening, for example, onto a terrace or patio 82c (shown fragmentarily). The remainder of the floor plan for the ground floor may be as desired, depending on the size of the townhouse unit and design considerations, as will be understood.

The floor plans for the main floor and ground floor of the FIG. 13 embodiment may be essentially the same as those shown in FIGS. 11 and 12 for the FIG. 10 embodiment, as should be evident.

It will also be appreciated that the invention is applicable to townhouses of the type indicated in FIG. 7 wherein the front portion of the townhouse unit 20'' is not planar but includes a projecting portion 100 (as for a garage 102, if desired). In such a unit, the standard service door 34'' could open into the garage 102 through wall 104 at grade, and the main entrance would be to the right of that door, as seen in FIG. 7, and of the type shown in FIGS. 1, 3, 4 and 6, including entrance stoop 43'' and a main door (not shown) accessible from that entrance stoop. The unit 20'' would also include a 2-level formal entrance area, similar to areas 50 and 56 shown in FIGS. 4 and 6, and other features of the invention, disclosed herein, as will be evident.

SUMMARIZING THE INVENTION IN A CONCEPTUAL SENSE AND IN A PRACTICAL, ECONOMIC SENSE

Conceptually, the novel ideas or embodiments of the invention are diametrically opposed to professional logic and townhouse building art thinking as to typical, basic, obvious townhouse functional design concepts in that: (1) It is not professionally logical to unaesthetically provide a fully exposed, detracting, standard, service door for individuals entering into the ground floor level, within the limited, formal, front elevation of a townhouse. (2) It is not professionally logical to locate that detracting, standard, service door in such a hitherto unlikely, constricted width, wall location between the formal front windows, and/or garage door, and main entrance door fenestration treatment. (That typically, constricted width, sensitively exposed, wall location is not obviously conceived as being a potentially usable and functional wall area as in the invention.) (3) It is illogical to include a detracting, fully exposed, standard, service door in the front of a commonly known, unpopularly formal, 3-story front townhouse. (The mere combination of these two aesthetically undesirable features is not only questionable from a professional standpoint, it is almost unrealistic from a practical standpoint, since the detracting, standard, service door admittedly is not currently a necessity, though it would nevertheless be desirable in the opinion of the inventor. The consideration of such an inclusion would logically and typically be dismissed out of hand, since the service door would be felt to be an impractical and unjustifiable increase in the cost of a typical townhouse unit. The assumption that one could achieve a positive solution that would be aesthetically acceptable to the buying public was not only unobvious, it was almost irrational, since the risk as to eventual public acceptance is, and increasingly remains, substantial to the inventor.) (4) It is neither obvious nor professionally logical to have an atypical, generally centrally located service entrance corridor at the ground floor level. (It is in fact novel to overcome critical width constraints and have that corridor terminate at the front wall, standard, service door and to have, as well, the mechanical room under the formal sunken entry, and the laundry room under the formal upper foyer as in the invention.) (5) It is totally unobvious to have a raised stoop to reach an intermediate main entrance door as part of the formal, main entrance and service entrance scheme, which allows the entrance sidewalk to be subtly, elevationally raised to achieve the intricate, unobvious, novel, exterior and interior step and stair arrangement at the said entrances. (6) The mere consideration of providing an unusually spacious, 2-level formal entrance area of substantially the same width throughout runs counter to professional and townhouse building art logic, since doing so would typically, adversely diminish vital room areas at the main (first floor) and ground floor levels. To have achieved such an overall entrance solution, including all sub-entrance area elements at the main floor, without detracting from other vital room areas is not only unobvious, it is critically novel. (7) It is not obvious to combine and substantially make coincident the total entrance circulation area at the main stair, landing area so that the resulting saved area, from the total, main entrance circulation sub-area that is typically excessive and inefficient, could be added to the definitive, 2-level formal entrance area, which in effect makes the 2-level area so unusually spacious without sacrificing other vital room areas. (8) To have achieved these conceptually unobvious embodiments of the invention in a currently unpopular, 3-story front townhouse, that appears to be and functionally works like a 2-story front townhouse is totally unobvious.

While the initial, general workings of the invention in an essentially conceptual sense were difficult to resolve, the necessary refinement of those workings within the parameters of reality, practicality and economy, resulted in problems of criticality that were seemingly insurmountable to resolve. It is implicit that townhouses, being a high density form of single family housing are built on high density zoned land that is extremely expensive. For that very reason it is economically mandatory to get as many townhouses on a per acre of ground basis as is allowable by the zoning board — usually about 10 townhouse units per acre. Consequently, townhouses are typically narrow in width.

At the general period in time the rudimentary inventive idea was conceived, townhouse zoned land in local suburban and rural areas was selling for about $18,000 – $25,000 per acre. During the years that the invention was diligently pursued and perfected, the value of townhouse zoned land was increasing astronomically. The same land is, for example, currently valued at $35,000 – $85,000 per acre, depending on location. It will be appreciated then, that while the initial townhouse unit, as conceived, was based on a width of 30 – 32 feet (atypically wide, but its length was atypically short), no sooner had the solution been resolved than the reality of increasing land cost necessitated narrowing the unit to 28 feet, then 26 feet, then 24 feet, until finally the units of the intended project were based on models that, for example, ranged from 24 feet down to 20 feet in width! It should be noted that these illustrative widths are for townhouse units typically having the main entrance door to one side. In the generally, center main entrance door variation of the invention, applicable to atypically wide townhouses (for example, as shown in FIGS. 10, 11, 12 and 13), the minimal desired width would be, for example, 28 feet.

Each successive stage of narrowing the townhouse, as noted and as necessitated by the reality of unprecedented, soaring land costs, represented a completed, formidable, systemized solution that had to be substantially revised as the units were narrowed in increments of 2 feet. This periodic narrowing and refinement of the townhouse unit resulted in critical horizontal and vertical dimensional tolerance problems that increasingly seemed insurmountable. These problems are summarized as follows:

Since the windows and the main door fenestration treatment in the front of a townhouse are typically constricted with respect to their horizontal spacing from each other, the blank wall space, horizontally between the main door, or door and stoop, and the formal, large windows, or windows and garage door, is too minimal in width to be obviously conceived by a professional as a potentially usable and functional wall area. By making the said formal windows, on the side horizontally opposite to the main entrance door, slightly and subtly narrower than may be typical and moving them slightly closer to the common sidewall, between townhouse units, of that said side (which makes the formal, main windows slightly off center to the room at the front of the townhouse unit), the said, central, blank wall space becomes wider to receive a standard, service entrance door for individuals.

Referring to FIGS. 3 and 10, it is seen that by making the aforementioned, central, blank wall area 15 or **15*c* wider to receive the standard service door 34 or 34*c*, the very inclusion of such service door creates additional narrow blank wall spaces and openings of varied widths (for example, along section line 5—5 or 12—12) than is typical. The wall spaces and openings are respectively: 11; 48; 12; 34; 13; 32 and 14 or 11*c*; 48*c*; 12*c*; 34*c*; 13*c*; 32*c*; 14*c*; 16 and 17**. To make the solution realistically practical it meant that all these various width blank wall spaces and openings, when typically using brick as an exterior wall finish material, had to be in standard, horizontal brick and joint coursing, which in turn had to match standard brick and joint coursing for the entire width of the townhouse, as between the first and second floor levels.

It will be appreciated that the narrower the townhouse becomes, the narrower the aforementioned blank wall spaces and openings become, which create critical horizontal dimensional tolerance problems. Furthermore, as seen in FIGS. 3 and 10, the narrower wall space 13 or **13*c* becomes, the steeper the angle of grade 33*a* or 33*ac* becomes, which if too steep, makes the solution functionally and aesthetically unacceptable. This specific grade condition directly relates to the determination of the total number of steps in: (1) corridor 72 or 72*c* in FIGS. 5 and 12; (2) in stoop 43*a* or 43*c* in FIGS. 3 and 10; and (3) in decorative stair 52 or 52*c* in FIGS. 4 and 11**. The exact, subtle distribution of the steps required at each of these locations was critical to the workings of the invention in a functional and aesthetically deceptive (2-story appearing embodiment) sense as has been thoroughly explained hereinabove.

The determination of the total number of steps involved in the two separate entrance door scheme of the invention in turn bears directly on the structural framing solution of the prototype townhouse unit. With 2 inch × 10 inch floor joists, the total number of risers or steps floor-to-floor required are 14 risers. With 2 inch × 8 inch floor joist framing, the total number of risers or steps floor-to-floor may be reduced to 13 risers. While the invention will work with 14 risers floor-to-floor, which is typical, it works optimally with 13 risers floor-to-floor. Thus, it will be appreciated that the determination of the total number of risers and the critical distribution of those risers or steps represented a vertical, dimensional tolerance problem that was directly related to the horizontal, dimensional tolerance problem, which in combination were crucial to the inventive solution.

It will be appreciated, as well, that the narrower in width the townhouse becomes, the more difficult it is to resolve the interior formal entrance area scheme (and service corridor entrance scheme at the ground floor level). As can be seen in FIGS. 4 and 11, the horizontal dimensional tolerances involved to achieve: (1) a two level formal entrance area 50 and 56, or **50*c* and 56*c*, of substantially the same width throughout; (2) a total circulation (sub) area 69 or 69*c* that is substantially coincident with the main stair landing (sub) area; and (3) a main U stair 68 or 68*c*** that is atypically compact and which dimensional factor is crucial to the entrance solution; all represented horizontal dimensional tolerance problems that were critical to resolve.

It will be further appreciated from these exampled, summary, practical and economic problems of the invention that the horizontal and vertical dimensional tolerances, which were so critical, were additionally complicated by the practical necessity of revising the invention and making each completed stage of the inventive plans and elevations narrower as the cost of townhouse, zoned land kept unexpectedly rising in an unprecedented manner. The seemingly endless trial and error juxtapositioning of the basic design elements or parts of the invention in elevation and plan to effect a practical solution, as the townhouse unit diminished in width, became increasingly difficult to resolve. Certainly, the apparent successful resolution of the critical, dimensional tolerances, clearly demonstrates that it was not mere professional, routinization to arrive at the optimum, practical, economic and aesthetic solution of the present invention.

Moreover, based on the foregoing disclosure, it is the inventor's contention that: (1) aside from the generally, centrally located, service entrance corridor embodiment of the invention at the ground floor level; (2) aside from the other general interior embodiments of the invention at the ground floor level; (3) aside from the general interior embodiments of the invention at the intermediate and main (first floor) levels as included in the entrance area scheme (including all sub-area entrance elements), which would encompass, for example, the spacious, two-level formal entrance area of substantially the same width throughout, (4) aside from the exterior 2-story front appearing embodiments of the invention (whether in essence the front windows and/or garage door are attached or unattached, vertically aligned or unaligned or whether the front wall is completely devoid of windows and/or a garage door); (5) aside from the "raised" stoop; and (6) aside from the main entrance door being located at an intermediate point between the main (first) floor and ground floor levels — there is no known multistoried townhouse until built with the ground floor level at the approximate grade line in the front and being generally 3-stories in height, which has a separate service door and formal main entrance door that is distinguished by: (a) a stoop or stair to the formal, main entrance door in the front which opens generally into the main (first) floor area; and (b) a fully exposed standard service door for individuals generally at grade in the front (in any fully exposed at grade location), which opens directly or essentially into the ground floor area, that is substantially at the grade line, wherein the said service door is neither located under a main entrance door stoop or stair nor is in general vertical alignment below the formal, main entrance door.

As to the main floor plan, as shown in FIGS. 5 and 11, it is the inventor's contention that: (1) aside from the configuration and location of the entrance closet; (2) aside from the configuration and location of the powder room; (3) aside from the configuration and location of the main stair; (4) aside from the existence of a fully exposed standard service door; (5) aside from a raised or unraised stoop, or no stoop at all, where the substantially level grade could be 6 inches ± below the threshold of the main entrance door; and (6) aside from the 2-story appearing embodiment of the invention — there is no known multistoried townhouse unit whose total interior main entrance plan area is distinguished by: (a) a formal entrance area of 2 levels and of substantially the same width throughout, with an interconnecting, fully exposed, decorative stair treatment; and (b) a total corridor subarea that is substantially coincident with the main stair landing sub-area.

As to the ground floor plan, it is the inventor's contention that: (1) aside from the generally centrally located service entrance corridor; (2) aside from the mechanical room under the sunken formal entry (whether that room or area is used for utilities, storage or other functional purposes); (3) aside from the laundry room under the upper foyer (whether that room or area is used for utilities, storage or other functional purposes); (4) aside from the 2-story appearing embodiments of the invention; (5) aside from the raised stoop; and (6) aside from the main entrance door being located at an intermediate point between the main (first) floor and ground floor levels—there is no known multistoried townhouse unit that has a fully exposed standard service door for individuals generally at grade in the front (in any fully exposed at grade location) which opens directly or essentially into the ground floor area, that is substantially at the grade line, wherein the said service door is neither located under a main entrance door stoop or stair nor is in general vertical alignment below the formal main entrance door.

Finally, it will be appreciated that this architectural, utility invention is intended to be built in competition with existing townhouse art. Consequently, the inherent details related for example to architectural construction; structural framing; mechanical equipment and ductwork; plumbing equipment, waste and vent lines; etc., all represented formidable and complex problems that had to be resolved practically and in an interrelated, systemized, professional manner. While no novel significance, per se, is being urged herein for such details, they were nevertheless integral to the complex and utilitarian design, decision-making process, that resulted in the refined and finalized, inventive solution.

In view of this reality and in awareness of the typical non-technical impression of architecture that prevails, it would seem highly questionable to view this invention as representing artwork subject matter. To the contrary, the novel distinctions or workings of this utility invention in elevation and in plan, as compared to existing townhouse art, are as specific, precise and critical in architectural solution as are the comparable specific, precise and critical workings of inventive mechanical subject matter.

Having thus described my invention, what is claimed is:

1. An improved townhouse unit of the type having a plurality of floors including ground and main or first floors which together define the living space for a single family therein so that there is interior communication for the family between all floors of the said townhouse unit and a front portion having a main entrance which includes at least a single door positioned at an intermediate location between said ground floor and said main or first floor for providing entrance into said main or first floor by way of a formal entrance wherein the improvement comprises a second entrance door horizontally spaced to side of and vertically spaced intermediately to said main entrance, said second door being substantially the same width as said single door in said main entrance said second door being fully exposed in said front portion and opening into the ground floor of said townhouse unit.

2. The structure defined in claim 1 wherein an exterior stoop or stair is provided extending generally from said main entrance door down to grade which would be generally at the elevation of the ground floor.

3. The structure defined in claim 2 wherein windows and a garage door are provided on said front portion of said townhouse unit opening respectively into said main or first floor and said ground floor and wherein said second entrance door is located entirely within a constricted width wall area, limited on one adjacent side by the said stoop and bounded on the other adjacent side by the vertical side of either said windows or said garage door, whichever is closest in horizontal distance to said stoop.

4. The structure defined in claim 2 wherein windows are provided on said front portion of said townhouse unit opening respectively into said main or first floor and said ground floor and wherein said second entrance is located entirely within a constricted width wall area, limited on one adjacent side by the said stoop and bounded on the other adjacent side by the vertical side of either of said windows, whichever is closest in horizontal distance to said stoop.

5. The structure defined in claim 1 wherein an exterior stoop or stair is provided extending generally from said main entrance door down to a second grade level, which at that location is disposed above a first grade level at said second entrance door that opens into said ground floor, and thereby constituting a generally raised-above-grade stoop or stair condition.

6. The structure defined in claim 5 and further including a sidewalk arranged generally at the same grade as the grade at said second entrance door and an entrance walk extending from said sidewalk in a gradually upwardly sloping direction to said second grade level at said exterior stoop leading to said main entrance door.

7. The structure defined in claim 6 and further including a service walkway extending from said entrance walk, intermediate the ends thereof, in a gradually downwardly sloping direction to said second entrance door.

8. The structure defined in claim 6 wherein the entrance walk has about a five percent to about a six percent slope.

9. The structure defined in claim 5 wherein windows are provided on said front portion of said townhouse unit opening respectively into said main or first floor and said ground floor and wherein said second entrance door is located entirely within a constructed width wall area, limited on one adjacent side by the said stoop and bounded on the other adjacent side by the vertical side of either said windows, whichever is closest in horizontal distance to said stoop.

10. The structure defined in claim 5 wherein windows and a garage door are provided on said front portion of said townhouse unit opening respectively into said main or first floor and said ground floor and wherein said second entrance door is located entirely within a constricted width wall area, limited on one adjacent side by the said stoop and bounded on the other adjacent side by the vertical side of either said windows or said garage door, whichever is closest in horizontal distance to said stoop.

11. The structure defined in claim 1 wherein at least one of said doors is generally recessed from the exterior face of the front wall in said front portion of said townhouse unit.

12. The structure defined in claim 1 wherein said ground floor and said second entrance door are both generally at grade at said front portion.

13. The structure defined in claim 1 wherein said ground floor is disposed slightly below the grade level at said second entrance door.

14. The structure defined in claim 1 wherein said second entrance door opens into a service entrance corridor provided on said ground floor.

15. The structure defined in claim 1 wherein said front portion is substantially planar.

16. The structure defined in claim 1 wherein vertically aligned windows are provided on said front portion of said townhouse unit opening respectively into said main or first floor and said ground floor, and means joining the exterior frames of said windows to give the appearance of a unitary frame structure, which, as it relates to said main entrance door that is at said intermediate location, makes the said townhouse unit appear from the outside to be generally two stories in height.

17. The structure defined in claim 1 wherein at least one window and a garage door are provided in a vertically aligned arrangement on said front portion of said townhouse unit opening respectively into said main or first floor and said ground floor, and means joining the exterior frames of said windows and garage door to give the appearance of a unitary frame structure, which, as it relates to said main entrance door that is at said intermediate location, makes the said townhouse unit appear from the outside to be generally two stories in height.

18. The structure in claim 1 and further including an interior, two-level formal entrance area into which said main entrance door opens, said entrance area being of substantially the same width throughout within said townhouse unit, the lower level of said interior entrance area being intermediate said ground and main or first floors and constituting a formal entry, and the upper level of said interior entrance area being substantially coplanar with said main or first floor, and constituting a formal foyer; and wherein said townhouse unit includes a second floor, and a main interior stairway connecting said first floor both to said ground and said second floor.

19. The structure defined in claim 18 wherein the two levels of said formal entrance area are interconnected by an exposed stairway having at least one open side thereof provided with a railing.

20. The structure defined in claim 12 wherein said formal foyer has a railing at the change in levels to the said formal entry.

21. The structure defined in claim 12 wherein said two-level formal entrance area and the generally immediately adjacent areas to said main stair and said two-level formal entrance area substantially constitute a total interior main entrance plan area in said unit, in which the landing area to said main stair at the main or first floor is substantially coincident with the total definable corridor area within said total interior main entrance plan area of said unit.

22. The structure defined in claim 15 wherein an entrance closet is arranged to open into said two-level formal entrance area.

23. The structure defined in claim 15 wherein an entrance closet is arranged to open into said total definable corridor area.

24. The structure defined in claim 15 wherein a powder room is arranged to open into said two-level formal entrance area.

25. The structure defined in claim 15 wherein a powder room is arranged to open into said total definable corridor area.

26. The structure defined in claim 18 wherein the opposite side of the floor of the formal entry forms the ceiling of a room positioned directly therebelow, the floor of said room being at ground floor level so that the vertical spacing between the floor and ceiling is reduced a distance equal to the distance between the level of the formal entry and the level of the first floor.

27. An improved townhouse unit of the type having a plurality of floors including ground and main or first floors which together define the living space for a single family therein so that there is interior communication for the family between all floors of the said townhouse unit and a front portion having a main entrance which includes at least a single door positioned at an intermediate location between said ground floor and said main or first floor for providing entrance into said main or first floor by way of a formal entrance wherein the improvement comprises a second entrance door horizontally spaced to side of and vertically spaced intermediately to said main entrance, said second door being substantially the same width as said single door in said main entrance, said second door being fully exposed in said front portion and opening into the ground floor of said townhouse unit, said ground floor being located at a first grade level along said front portion, a stoop having top and bottom portions leading to said main entrance, the bottom portion of said stoop being positioned at a second grade level vertically spaced a predetermined distance above the first grade level, and an entrance walk extending between the bottom portion of said stoop and a curb said entrance walk gradually sloping downwardly from the second grade level.

28. The structure defined in claim 27 wherein the entrance walk has about a five percent to about a six percent slope.

29. The structure defined in claim 27 and further including a sidewalk arranged generally at the same grade as the grade at said second entrance door and an entrance walk extending from said sidewalk in a gradually upwardly sloping direction to said second grade level at said exterior stoop leading to said main entrance door.

30. The structure defined in claim 1 wherein windows are provided on said front portion of said townhouse unit opening respectively into said main or first floor and said ground floor and wherein said second entrance door is located entirely within a constructed width wall area, limited on one adjacent side by the said stoop and bounded on the other adjacent side by the vertical side of either said windows, whichever is closest in horizontal distance to said stoop.

31. The structure defined in claim 27 wherein windows and a garage door are provided on said front portion of said townhouse unit opening respectively into said main or first floor and said ground floor and wherein said second entrance door is located entirely within a constricted width wall area, limited on one adjacent side by the said stoop and bounded on the other adjacent side by the vertical side of either said windows or said garage door, whichever is closest in horizontal distance to said stoop.

32. The structure defined in claim 27 and further including an interior, two-level formal entrance area into which said main entrance door opens, said entrance area being of substantially the same width throughout within said townhouse unit, the lower level of said interior entrance area being intermediate said ground and main or first floors and constituting a formal entry, and the upper level of said interior entrance area being substantially coplanar with said main or first floor, and constituting a formal foyer; and wherein said townhouse unit includes a second floor, and a main interior stairway connecting said first floor both to said ground floor and said second floor.

* * * * *

UNITED STATES PATENT OFFICE

CERTIFICATE OF CORRECTION

Patent No. 4,041,661 Dated August 16, 1977

Inventor(s) Myron Stuart Hurwitz

It is certified that error appears in the above-identified patent and that said Letters Patent are hereby corrected as shown below:

Column 3, Line 65, change "emtrance" to -- entrance --;
Column 5, Line 29, change -grand- to -- "grand" --;
Line 31, change "where" to -- were --;
Line 39, change "tyical" to -- typical --;
Line 40, change "an" to -- in --;
Column 6, Line 25, change "shuld" to -- should --;
Line 62, change "ad" to -- and --;
Column 8, Lines 54 and 63, change -U- to -- "U" --;
Column 9, Lines 22, 24 and 39, change -U- to -- "U" --;
Line 47, after "up" delete "to";
Line 46, delete "some" and insert -- someone --;
Column 10, Line 28, delete -grade- and insert -- "grade" --;
Line 34, delete "designte" and insert -- designate --;
Column 13, Line 64, delete the comma after "townhouse";
Column 20, Lines 40, 45, 50 and 53, delete -tolerance- and insert -- "tolerance" --;
Lines 40, 46, 50 and 53, delete -length of course- and insert -- "length of course" --;
Column 21, Lines 38 and 39, delete "a typical" and insert -- atypical --;
Column 22, Lines 52, 53 and 54, delete entire heading "Summarizing the Details of the Two Separate, Standard Entrance Door Scheme, Including Related Site Detils Not Previously Explained" and insert -- SUMMARIZING THE DETAILS OF THE TWO SEPARATE, STANDARD ENTRANCE DOOR SCHEME, INCLUDING RELATED SITE DETAILS NOT PREVIOUSLY EXPLAINED --;
Line 65, change "joint" to -- joist --;
Column 23, Line 22, change -U- to -- "U" --;
Line 46, delete "or" and insert -- of --;
Line 59, change "forml" to -- formal --;

UNITED STATES PATENT OFFICE

CERTIFICATE OF CORRECTION

Patent No. 4,041,661 Dated August 16, 1977

Inventor(s) Myron Stuart Hurwitz

It is certified that error appears in the above-identified patent and that said Letters Patent are hereby corrected as shown below:

Column 28, Line 63, change -U- to -- "U" --;
Column 29, Line 29, after "throughout" delete the comma and insert --;--;
Line 39, delete "until" and insert -- unit --;
Line 59, change -raised- to -- "raised" --;
Line 60, change -unraised- to -- "unraised" --;
Column 30, Line 13, change -raised- to -- "raised" --;
Line 30, after "equipment" delete the comma and insert --;--;
Line 64, after "entrance" insert a comma;
Column 31, Line 16, after "entrance" insert -- door --;
Line 47, change "constructed" to -- constricted --;
Column 32, Line 23, change "windows" to -- window --;
Line 41, after "ground" insert -- floor --;
Line 46, change "claim 12" to -- claim 18 --;
Line 49, change "claim 12" to -- claim 18 --;
Line 58, change "claim 15" to -- claim 21 --;
Line 61, change "claim 15" to -- claim 21 --;
Line 64, change "claim 15" to -- claim 21 --;
Column 33, Line 1, change "claim 15" to -- claim 21 --;
Column 34, Line 8, change "claim 1" to -- claim 27 --;
Line 12, change "constructed" to -- constricted --.

Signed and Sealed this

*Third* Day of *October 1978*

[SEAL]

*Attest:*

RUTH C. MASON
*Attesting Officer*

DONALD W. BANNER
*Commissioner of Patents and Trademarks*